US008002447B2

(12) United States Patent
Patti

(10) Patent No.: US 8,002,447 B2
(45) Date of Patent: Aug. 23, 2011

(54) SURFACE-MOUNTED LIGHTING FIXTURE

(76) Inventor: Anthony Patti, Highland Park, NJ (US)

( * ) Notice: Subject to any disclaimer, the term of this patent is extended or adjusted under 35 U.S.C. 154(b) by 399 days.

(21) Appl. No.: 12/370,980

(22) Filed: Feb. 13, 2009

(65) Prior Publication Data

US 2009/0296410 A1 Dec. 3, 2009

Related U.S. Application Data

(60) Provisional application No. 61/065,982, filed on Feb. 15, 2008.

(51) Int. Cl.
*F21V 33/00* (2006.01)

(52) U.S. Cl. ..... 362/382; 362/151; 362/234; 362/368; 362/152

(58) Field of Classification Search ..... 362/151, 362/253, 234, 362, 368, 396, 382, 152
See application file for complete search history.

(56) References Cited

U.S. PATENT DOCUMENTS

| | | | | |
|---|---|---|---|---|
| 4,449,167 | A * | 5/1984 | Cohen | 362/269 |
| 4,700,277 | A * | 10/1987 | Moore | 362/548 |
| D293,133 | S * | 12/1987 | Wood | D26/28 |
| 4,851,977 | A | 7/1989 | Gary | |
| 4,888,669 | A | 12/1989 | Hanson | |
| 5,160,202 | A | 11/1992 | Legare | |
| 5,249,108 | A | 9/1993 | Gary | |
| 5,943,827 | A | 8/1999 | Okerlund | |
| 5,951,144 | A | 9/1999 | Gavigan et al. | |
| 6,179,435 | B1 | 1/2001 | Wilson | |
| 6,547,589 | B2 | 4/2003 | Magyar et al. | |
| 6,578,321 | B2 | 6/2003 | Layne | |
| 6,796,684 | B1 | 9/2004 | Beadle | |
| 6,866,032 | B2 | 3/2005 | Magyar et al. | |
| 6,881,094 | B2 | 4/2005 | Magyar et al. | |
| 6,976,765 | B2 | 12/2005 | Helenowski | |
| 7,234,846 | B2 * | 6/2007 | Chen | 362/365 |
| 7,290,904 | B2 | 11/2007 | Miller | |
| D564,128 | S | 3/2008 | Hartman | |
| D576,763 | S | 9/2008 | Hartman | |
| 7,524,077 | B2 | 4/2009 | Hartman | |
| 2006/0114680 | A1 | 6/2006 | Miller | |
| 2007/0263396 | A1 | 11/2007 | Miller | |
| 2008/0062679 | A1 | 3/2008 | Hartman | |
| 2009/0213580 | A1 | 8/2009 | Hartman | |

OTHER PUBLICATIONS

Product Sheet from Cast Lighting LLC for CAST Engineered Wall Light Product Information (CEWL5CB), 1 page, Copyright 2008.

(Continued)

*Primary Examiner* — Laura Tso
(74) *Attorney, Agent, or Firm* — Greenberg Traurig, LLP

(57) ABSTRACT

A lighting fixture includes a modular lamp assembly and a lighting fixture comprising a mounting plate and lamp holder affixed to the mounting plate. The lamp holder has flexible retaining members which extend away from the mounting plate. The retaining members have respective securing means to secure the modular lamp assembly at a fixed angle relative to the mounting plate. A flange on the lamp holder guides an electrical cord. This arrangement allows safe and convenient replacement of the modular lamp assembly. A skirt affixed to the mounting plate protects the lamp holder and modular lamp assembly and provides an aesthetically pleasing appearance. The lighting fixture may be readily mounting to hardscape or wooden construction. A strain relief for the electrical cord in the lighting fixture includes an elastic plug and stopper molded to the cord as a single body, and fits into a hole in the flange.

23 Claims, 19 Drawing Sheets

OTHER PUBLICATIONS

"Product Update", Vista Professional Outdoor Lighting, 1 page, published prior to Jul. 9, 2007.

Product Sheet from HUN3A Productions, Ltd., Auckland, New Zealand, 1 page, undated.

Newsletter, "Landscape Lifestyles", No. 7, copyright 2005, Allan Block corporation, MN, 6 pp., viewed on Mar. 10, 2008 at <http://www.allanblock,com/retainingwalls/newsletter/.

Photograph of light fixture by Integral Lighting, Wernersville, PA, bottom view, undated.

* cited by examiner

SURFACE-MOUNTED LIGHTING FIXTURE

CROSS-REFERENCE TO RELATED APPLICATIONS

This application claims the benefit of U.S. Provisional Patent Application No. 61/065,982, filed on Feb. 15, 2008, which is incorporated herein by reference in its entirety.

BACKGROUND OF THE INVENTION

Lighting fixtures for mounting on retaining walls or under steps, decks or railings are known in the art. With many of these fixtures, removal and replacement of the bulbs can be difficult, requiring that bulb covers or the fixtures themselves be removed so that the bulbs can be seen and accessed. Further, the process of removing the bulbs presents a risk of burns or electrical shocks. Water drainage or condensation may penetrate the bulb cover, thereby damaging the electrical components, increasing the risk of electrical shocks or failure of the lamp. Further, many of the known lighting fixtures are arranged to direct light downwards, failing to provide more than narrow fields of illumination. Such fixtures may also produce shadows or hot spots of intense light, which can be aesthetically displeasing.

SUMMARY OF THE INVENTION

In a first embodiment, the present invention comprises a lighting fixture for use with a modular lamp assembly. The lighting fixture includes a mounting plate with a lamp holder affixed thereto. The lamp holder has first and second retaining members extending away from the mounting plate, each of the retaining members including a respective securing means to hold the lamp assembly at a fixed angle relative to the mounting plate. The lighting fixture also includes a skirt that is attached to the mounting plate and has a curved edge that approximates the curvature of the transparent cover of the lamp assembly to aid in the even distribution of light from a light source within the lamp assembly.

In a second embodiment, the present invention comprises a lighting fixture having the features of the first embodiment, and the skirt is attached to the mounting plate by affixing stop members at the sides of the skirt to extensions at the sides of the mounting plate.

In a third embodiment, the present invention comprises a lighting fixture having the features of the first embodiment, and the mounting plate has a depth that is approximately the same as the depth of the lamp holder.

In a fourth embodiment, the present invention comprises a lighting fixture having the features of the first embodiment, and a second skirt attached to the mounting plate in a mirror image of the attachment of the skirt of the first embodiment.

In a fifth embodiment, the present invention comprises a lighting fixture having the features of the first embodiment, and the skirt has a first portion that extends transversely to the mounting plate, a second portion, attached to the first portion, that extends over the mounting plate and past the lamp holder, and stop members at the sides of the skirt that are attached to the first and second portions and extend past the lamp holder.

In a sixth embodiment, the present invention comprises a lighting fixture having the features of the fifth embodiment, and the stop members have cut-outs that enable a close fit between the skirt and a stepped structure.

In a seventh embodiment, the present invention comprises a lighting fixture having the features of the fifth embodiment, and the skirt has tabs inside the skirt that may be attached to the mounting plate.

In an eighth embodiment, the present invention comprises a lighting fixture having the features of any of the first through seventh embodiments, and a strain relief having a plug and stopper molded together as a single body and to an electrical cord that is installed in the lighting fixture.

BRIEF DESCRIPTION OF THE FIGURES

For a better understanding of the present invention, reference is made to the following detailed description of the exemplary embodiments considered in conjunction with the accompanying drawings, in which.

DETAILED DESCRIPTION OF THE INVENTION

Figure 1:
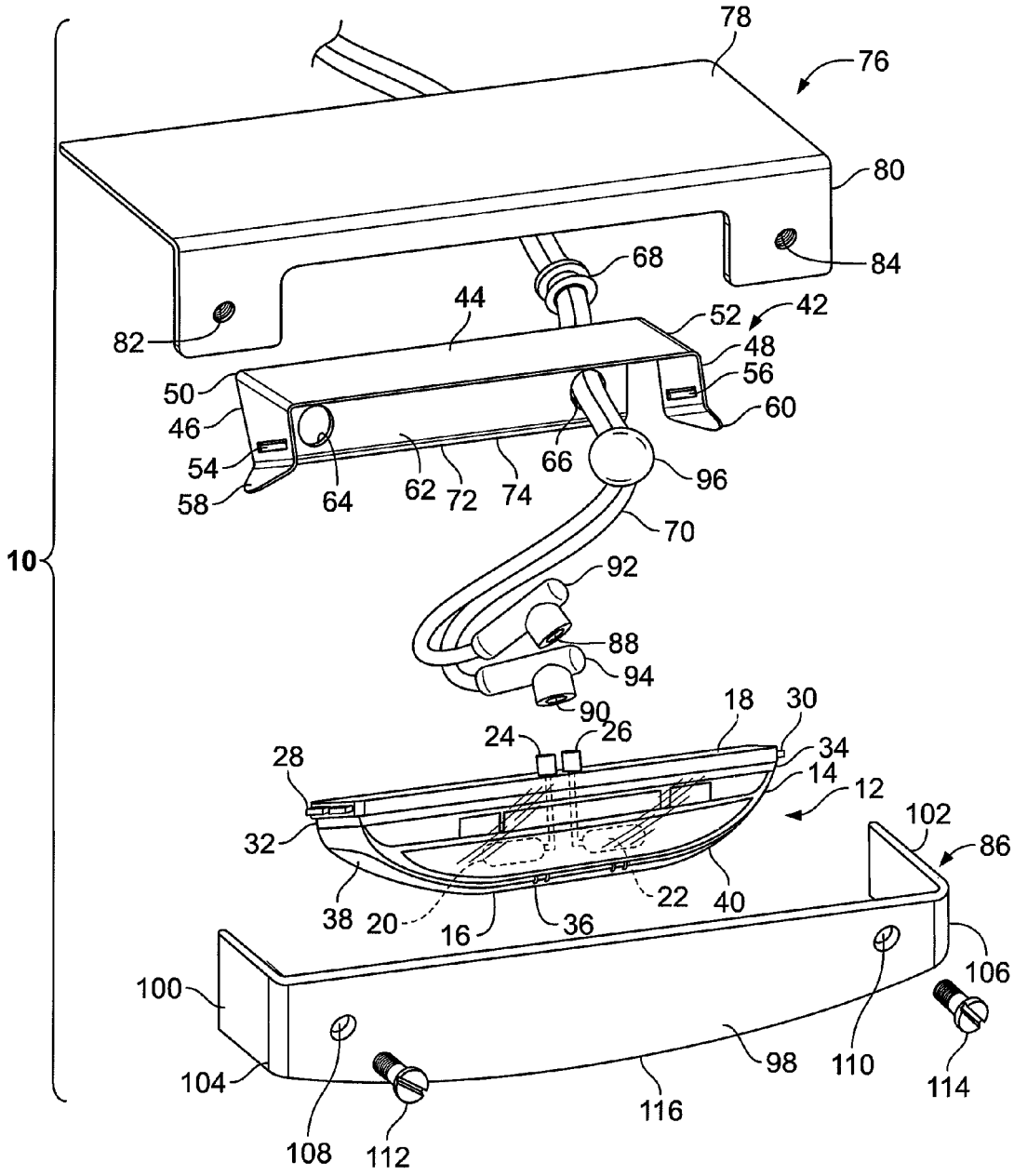
FIG. 1 is a perspective exploded view, looking from above, of a lighting fixture according to a first exemplary embodiment of the present invention.

FIG. 1 is an exploded view of a lighting fixture 10 according to a first exemplary embodiment of the present invention. The view is taken from the front of the lighting fixture 10. Orientations and views discussed with respect to this embodiment, such as "front", "rear", "right", "left", "top", "bottom", "inward" and "outward", are relative to the view presented in FIG. 1, except where variations from this scheme are explicitly described.

The lighting fixture 10 comprises a sealed modular lamp assembly 12, having a housing 14 with a light-transmitting cover 16 an electrically-insulating back plate 18. The back plate 18 is sealed to the cover 16 so as to prevent liquids or water vapor from entering the housing 14. The modular lamp assembly 12 further contains one or more self-contained light sources, such as the light bulbs 20,22 of the embodiment of the modular lamp assembly 12 shown in FIG. 1. The light sources are electrically connected to electrical contacts, such as the electrically-conductive posts 24, 26 exposed at the back plate 18. The modular light assembly 12 is also provided with rigid tabs 28, 30 protruding from opposite ends 32, 34 of the housing. In the embodiment of FIG. 1, the tabs 28, 30 are provided on the cover 16.

The cover 16 may be transparent or translucent, clear or colored, and may contain optical elements to distribute light from the light sources in a desired pattern. For example, in the embodiment of FIG. 1, the cover 16 is shaped such that light from the light bulbs 20, 22 may be directed through the front side 36 and sloped sides 38, 40 of the cover 16, thus providing even illumination. The cover 16 may be made of any of a number of light-transmitting materials, such as the impact-resistant polycarbonate plastic known as LEXAN®. An example of a modular lamp assembly 12 that may be beneficially employed in lighting fixtures according to the embodiment illustrated in FIG. 1 is Model No. 19200 manufactured by Truck-Lite Company (Falconer, N.Y.).

The lighting fixture 10 further comprises a lamp holder 42 having a substantially planar middle portion 44 and flexible retaining members 46, 48 at opposite ends 50, 52 of the middle portion 44. The retaining members 46, 48 extend out of the plane of the middle portion 44 and may be perpendicular thereto. The retaining members 46, 48 are provided with slots 54, 56 that are sized and shaped to releasably engage the tabs 28, 30 of the modular lamp assembly 12. End portions 58, 60 of the retaining members 46, 48 may be angled outwardly from the middle portion 44 of the lamp holder 42 so as to act as levers for flexing the retaining members 46, 48 during removal and replacement of the modular lamp assembly 12, as discussed elsewhere herein. Angled end portions 58, 60 are referred to hereinafter as wings 58, 60.

The lamp holder 42 may also be provided with a flange 62 at the back of the lamp holder 42 that extends out of the plane of the middle portion 44 of the lamp holder 42 and may be perpendicular thereto. If present, the lamp holder flange 62 extends in the same general direction as the retaining members 46, 48 (i.e., they extend away from the same face, visible in FIG. 1, of the middle portion 44 of the lamp holder 42). The lamp holder flange 62 may have one or more openings, such as openings 64, 66, which may be sized to receive an elastic grommet 68 through which an electrical cord 70 may pass. The arrangement of the electrical cord 70 and grommet 68 with respect to the other elements of the lighting fixture 10 will be discussed more fully elsewhere herein. The lamp holder flange 62 may also be provided with a lip 72 along the free edge 74 of the lamp holder flange 62. In the embodiment of FIG. 1, the lip 72 is continuous along the free edge 74 of the lamp holder flange 62 and is bent slightly toward the front of the lamp holder 42. As will be evident to a person of ordinary mechanical skill, it is not necessary that the lip 72 be a single continuous piece. It may be noted that the lamp holder flange 62 is not a necessary part of the lamp holder 42, but, when provided as in the embodiment of FIG. 1, may advantageously serve to guide the electrical cord 70 and provide support to the modular lamp assembly 12, as will be discussed elsewhere herein. Further, the free edge 74 or the lip 72 of the lamp holder flange 62 may be used to guide the positioning of the lamp holder assembly 12 between the retaining members 46, 48, as is discussed elsewhere herein.

The middle portion 44 of the lamp holder 42, retaining members 46, 48 and lamp holder flange 62 are sized and shaped so as to secure the modular lamp assembly 12 in a fixed position when the tabs 28, 30 are engaged with the slots 54, 56, respectively. The slots 54, 56 may be oriented such that the modular lamp assembly 12 projects its light at a desired angle (e.g., slots 54, 56 may be oriented at 30 degrees from the plane of the mounting plate body, so that light is directed away from the mounting plate body at an angle of 60 degrees). The orientation of the slots 54, 56 can be varied for different fixtures.

Lighting fixture 10 further comprises a mounting plate 76 having a substantially flat body 78 and a mounting plate flange 80 that extends out of the plane of the mounting plate body 78 and may be perpendicular thereto. In the embodiment of FIG. 1, the mounting plate flange 80 is provided with at least two threaded openings 82, 84, which are used in fastening a skirt 86 to the mounting plate flange 80, as is discussed more fully elsewhere herein. The mounting plate flange 80 of the embodiment of FIG. 1 is U-shaped and is configured so that the mounting plate flange 80 will not block removal or replacement of the modular lamp assembly 12 in the lamp holder 42.

The mounting plate body 78 and the middle portion 44 of the lamp holder 42 are constructed such that they may be attached one to the other. For example, in the embodiment of FIG. 1, the middle portion 44 of the lamp holder 42 may be permanently attached to the mounting plate body 78 by spot welding. Other methods of attaching these components will be understood by one having ordinary skill in the mechanical arts. Suitable methods may include the use of screws, adhesives or tongue-and-groove arrangements.

The lighting fixture 10 is further provided with electrical components 70, 88, 90 to conduct electrical current to the modular lamp assembly 12. The embodiment of FIG. 1 includes an electrical cord 70 having wires therein (not shown) which are electrically connected to electrically-conductive sockets 88, 90. The sockets 88, 90 are sized and shaped to fit securely over the respective posts 24, 26, so as to form mechanical and electrical connections with the posts 24, 26. The sockets 88, 90 are insulated and protected by socket holders 92, 94, which may be located at one end of the electrical cord 70. In the embodiment of FIG. 1, the electrical cord 70 is shown as being routed through opening 66 with the socket holders 92, 94 in front of the lamp holder flange 62. The electrical cord 70 is provided with a stopper 96 to prevent the electrical cord 70 and socket holders 92, 94 from being withdrawn through the opening 66, and is positioned to ensure that enough of the electrical cord 70 remains in front of the lamp holder flange 62 such that the socket holders 92, 94 may be conveniently manipulated so as attach the sockets 88, 90 to the posts 24, 26 or remove them therefrom while the modular lamp assembly 12 is detached from the lamp holder 42. The elastic grommet 68 is sized and shaped such that it may be fitted snugly into the opening 66 and may also allow the electrical cord 70 to pass through it. Various suitable means of connecting the lighting fixture 10 to a source of electrical power (not shown), such as using electrical plugs, batteries, or power taps, will be apparent to persons having ordinary skill in electrical installations.

The lighting fixture 10 is also provided with a skirt 86. The skirt 86 has a face plate 98 with stop members 100, 102 at its respective ends 104, 106. The stop members 100, 102 extend out of the plane of the face plate 98 and may be perpendicular thereto. In the embodiment of FIG. 1, the skirt 86 is provided with openings 108, 110 which may be aligned with the threaded openings 82, 84, respectively, of the mounting plate flange 80 such that the skirt 86 may be attached to the mounting plate flange 80 using screws, such as screws 112, 114, inserted through openings 108, 110 and respective threaded openings 82, 84. Other methods of fastening the skirt 86 to the mounting plate flange 80, such as by the use of adhesives, will be understood by one having ordinary skill in the mechanical arts. In other embodiments of the lighting fixture 10, a gasket (not shown) may be installed between the face plate 98 and the mounting plate flange 80 to provide additional protection against the infiltration of water.

In the embodiment of FIG. 1, the skirt 86 is sized and shaped to conceal the mounting plate flange 80 and a substantial portion of the cover 16 of the modular lamp assembly 12 when the lighting fixture 10 is assembled and viewed from the front. In some embodiments of the skirt 86, the face plate 98 and stop members 100, 102 are opaque, but may be made of a material that transmits light and may be provided with optical or dichroic lenses. The face plate 98 or stop members 100, 102 may be painted, embossed, debossed or textured, or other surface treatments may be applied. In the embodiment of FIG. 1, the skirt 86 is crescent-shaped along its lower edge 116, approximating the curvature of the cover 16 of the modular lamp assembly 12 in the embodiment of FIG. 1. In this embodiment, an effect of the crescent-shape is that light passing through the sloped sides 38, 40 of the cover 16 is not blocked by the face plate 98 or stop members 100, 102.

Figure 2:
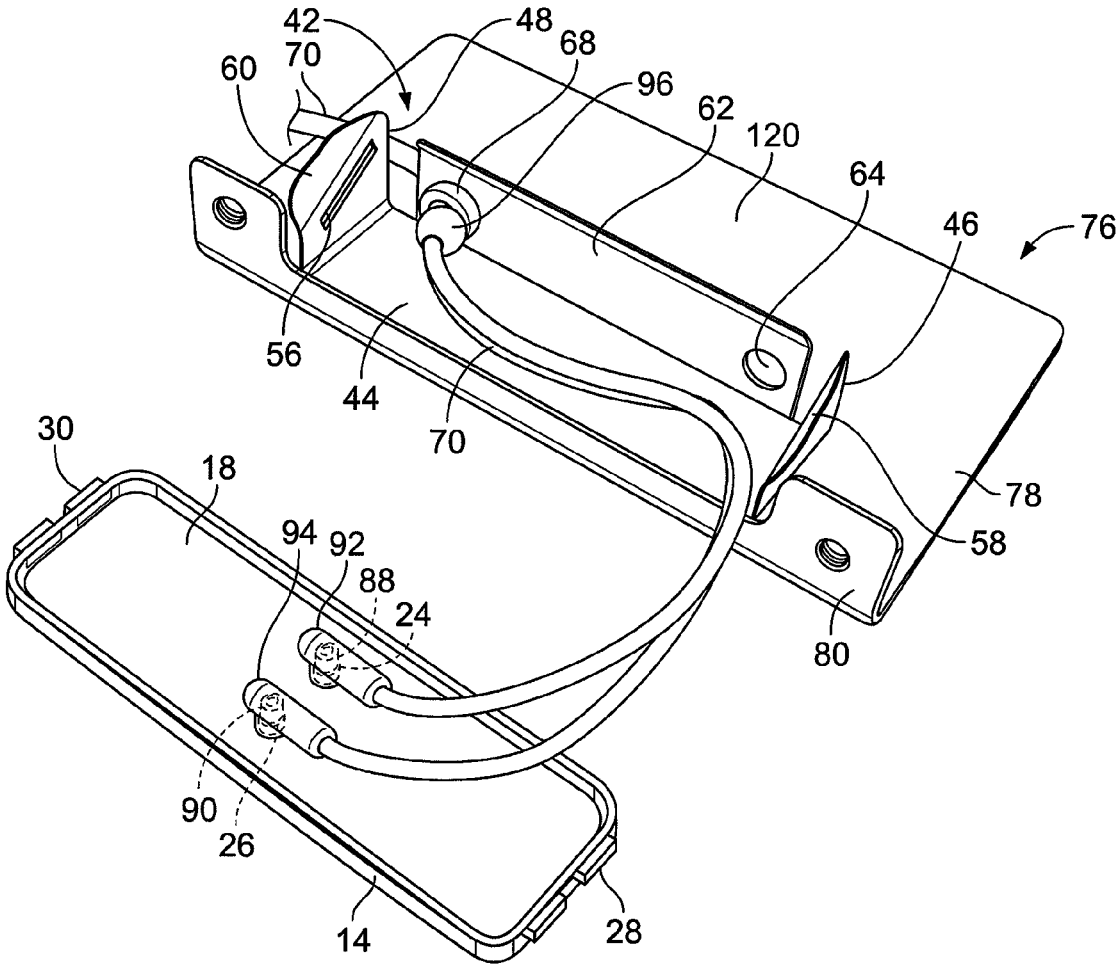
FIG. 2 is a first perspective view, looking from below, of components of the lighting fixture of FIG. 1 in a partially-assembled state.
Figure 3:
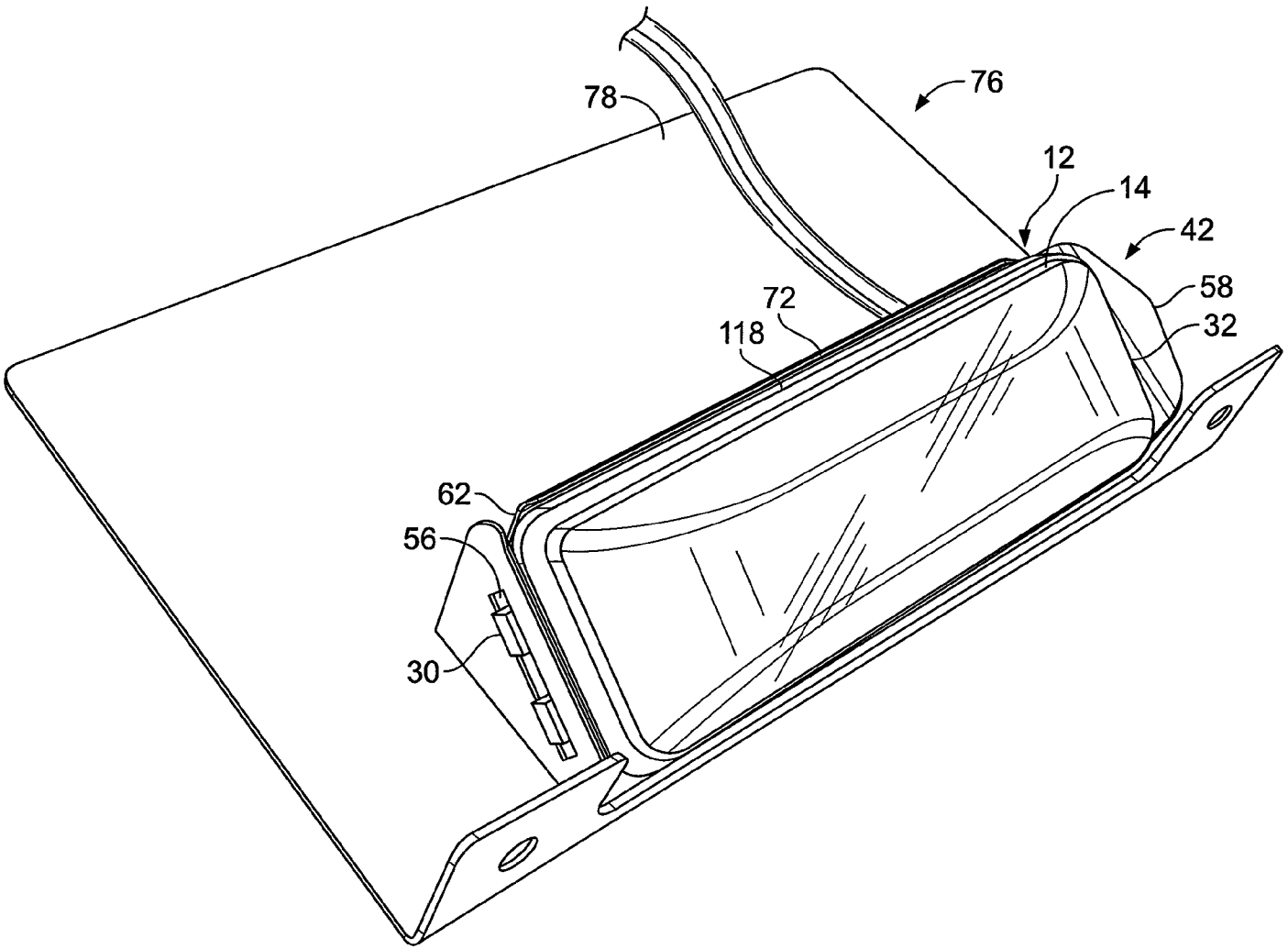
FIG. 3 is a second perspective view, looking from below, of components of the lighting fixture of FIG. 1 in another partially-assembled state.
Figure 4:
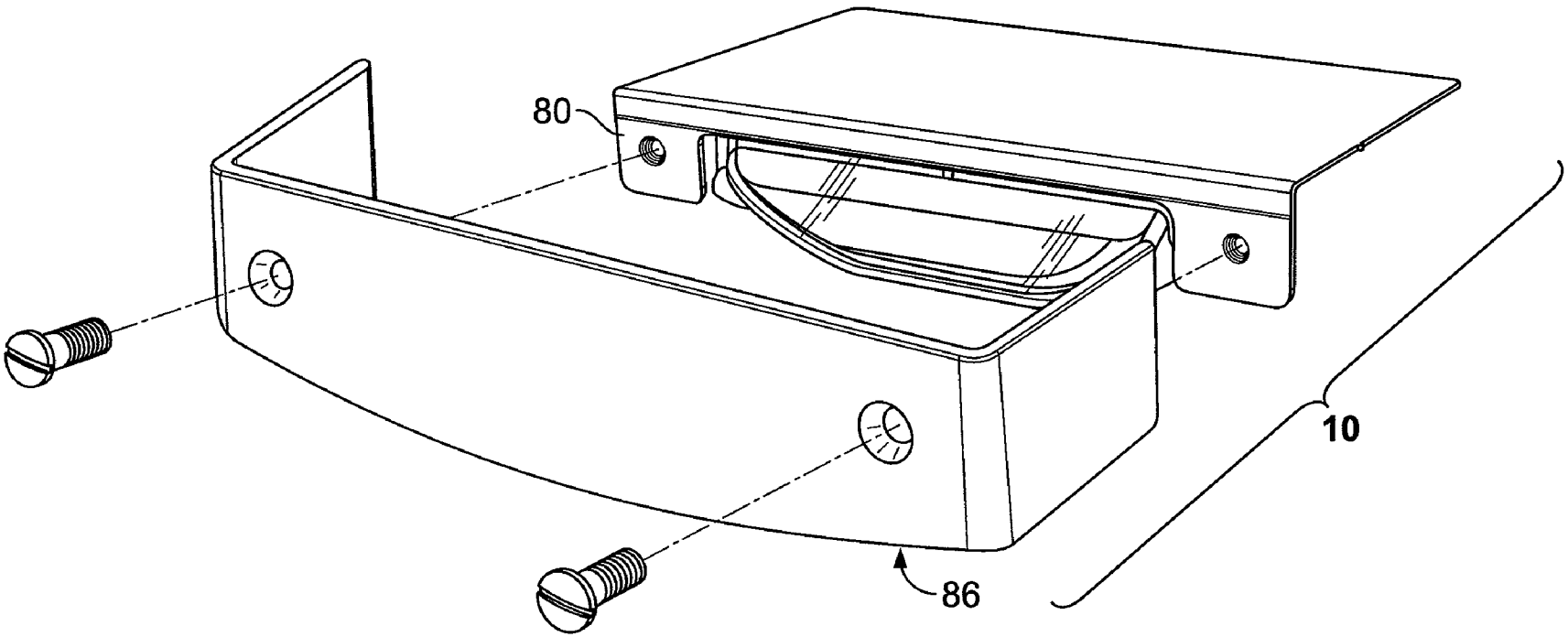
FIG. 4 is a third perspective view, looking from above, of the lighting fixture of FIG. 1 in yet another partially-assembled state.

FIGS. 2 through 4 illustrate components of the lighting fixture 10 of FIG. 1 in various stages of assembly. These figures, when read in succession, suggest a convenient sequence for assembling the lighting fixture 10. However, as will be obvious from discussions elsewhere herein, the figures do not limit the sequence in which the parts may be assembled.

In FIG. 2, which is a view beneath the mounting plate 76, and includes a view of the back plate 18 of modular lamp assembly 12, the middle portion 44 of the lamp holder 42 has been affixed to an underside 120 of the mounting plate body 78. The lamp holder 42 is located proximate to the mounting plate flange 80 such that the socket holders 92, 94 of the electrical cable 70 are readily accessible from in front of the lighting fixture 10. The elastic grommet 68 is secured within opening 66 (visible in FIG. 1, but concealed by grommet 68 in FIG. 2) in the lamp holder flange 62 with the electrical cord 70 through it. The stopper 96 is positioned relative to the socket holders 92, 94 such that there is enough electrical cord 70 between the stopper 96 and the socket holders 92, 94 to allow the socket holders 92, 94 and the back plate 18 of the modular lamp assembly 12 to be conveniently accessed when the modular lamp assembly 12 is free of lamp holder 42. The posts 24, 26 of the modular lamp assembly 12 are securely held within the sockets 88, 90 in socket holders 92, 94.

In FIG. 3, which is also a view beneath the mounting plate 76, the modular lamp assembly 12 has been secured in the lamp holder 42. The lamp holder tab 30 can be seen within the respective slot 56. The other tab is situated in the other slot at the end 32 of the housing 14, but they are concealed by the modular lamp assembly 12 and retaining member wing 58 in this view. A rear edge 118 of the housing 14 is supported by the lip 72 of the lamp holder flange 62.

FIG. 4 shows the front of the partially-assembled lighting fixture 10 of FIG. 3 before the skirt 86 is attached to the mounting plate flange 80. The lighting fixture 10 is shown in an orientation in which it may be installed in a masonry wall.

Figure 5:
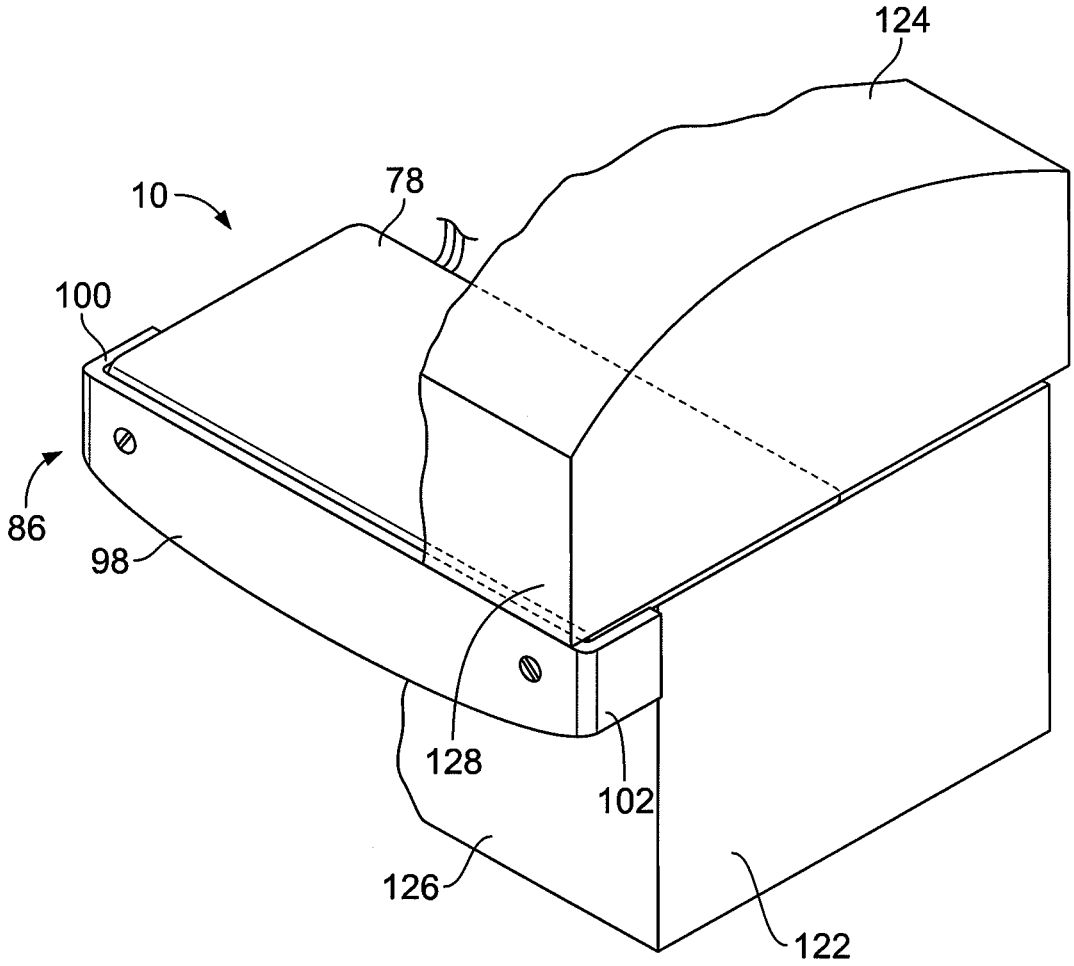
FIG. 5 is a perspective view, looking from above, of the lighting fixture of FIG. 1 in an installation according to the present invention.

FIG. 5 is an environmental view of the fully-assembled lighting fixture 10 in one of a number of possible installations. In the particular installation illustrated in FIG. 5, the mounting plate body 78 is positioned between a masonry block 122 and a capstone 124, such as may be used in masonry retaining walls, in such a way that the capstone 124 rests on the mounting plate body 78. The stop members 100, 102 are in contact with the face 126 of the masonry block 122, thus limiting the distance between the face plate 98 of the skirt 86 and the face 126 of the masonry block 122. In this particular installation, the capstone 124 overhangs the masonry block 122 by a distance that is about the same as the lengths of the respective stop members 100, 102, thus positioning the face 128 of the capstone 124 about even with the face plate 98. Other overhang distances can be accommodated by selecting skirts with longer or shorter stop members, as dictated by installation design or site conditions. The stop members 100, 102 may also be cut to a desired length, if needed. Further, it is not necessary that the stop members 100, 102 contact the face 126 of the masonry block 122, but they may, instead, be spaced away from the face 126 of the masonry block 122.

Possible installations of the lighting fixture 10 are not limited to installation in masonry retaining walls. For example, the lighting fixture 10 may be installed below an overhang between a stair tread and a riser in stone or wooden stairs. The lighting fixture 10 may also be installed between masonry blocks or wooden ties that are flush with one another, although such installations may not be preferred for reasons of aesthetics or safety. Other useful installations of the lighting fixture 10 will be apparent to those persons knowledgeable in the construction trades or the arts of hardscape or landscape design.

The various elements of the lighting fixture 10 illustrated in FIGS. 1-4, and discussed with reference thereto, should be sized and shaped such that, when the lighting fixture 10 is fully assembled and installed, the modular lamp assembly 12, the retaining members 46, 48 of the lamp holder 42, and the socket holders 92, 94 of the electrical cord 70 are readily accessible from beneath the lighting fixture 10. For an installation of the lighting fixture 10 such as those discussed with reference to FIG. 5, such access should be sufficient to allow removal and replacement of the modular lamp assembly 12 without removing the skirt 86 from the mounting plate flange 80. However, in other embodiments of the lighting fixture 10, removal of the skirt 86 may be desirable or necessary to allow the modular lamp assembly 12 to be removed or replaced. With all such arrangements in mind, the following paragraphs discuss the removal and replacement of the modular lamp assembly 12 in the assembled lighting fixture 10. The identification of the various elements of the lighting fixture is made with reference to FIGS. 1-4.

Beginning with a fully-assembled lighting fixture 10, the modular lamp assembly 12 may be removed from the lamp holder 42 by flexing the retaining members 46, 48 away from each other, thus releasing the tabs 28, 30 from their respective slots 54, 56. This may conveniently be done by pressing the wings 58, 60 of the retaining members 46, 48 outward, at least in embodiments where such wings 58, 60 are provided. The modular lamp assembly 12 can then be pulled away from the lamp holder 42, exposing the back plate 18 and the socket holders 92, 94 of the electrical cord 70. The modular lamp assembly 12 and the socket holders 92, 94 are then pulled away from each other so as to remove the posts 24, 26 of the modular lamp assembly 12 from the sockets 88, 90.

To replace the modular lamp assembly 12 in the lamp holder 42, the modular lamp assembly 12 and socket holders 92, 94 are manipulated so as to insert the posts 24, 26 into the respective sockets 88, 90, such that the posts 24, 26 are electrically and mechanically connected to the sockets 88, 90. The retaining members 46, 48 are then flexed away from each other, and the modular lamp assembly 12 is inserted between the retaining members 46, 48 such that each of the tabs 28, 30 is positioned within a respective slot 54, 56. In embodiments where wings 58, 60 are provided, the retaining members 46, 48 may be flexed outward by pressing the ends 32, 34 of the housing 14 against the wings 58, 60 until the tabs 28, 30 snap securely into place in their respective slots 54, 56. Where a lamp holder flange 62 is present, the modular lamp assembly 12 may be guided into position by resting the rear edge 118 of the lamp housing 14 on the free edge 74 or lip 72 of the lamp holder flange 62, while pressing the ends 32, 34 of the housing 14 on the wings 58, 60. In the absence of wings 58, 60, the retaining members 46, 48 may be flexed manually and the tabs 28, 30 inserted individually into their respective slots 54, 56.

Figure 6:
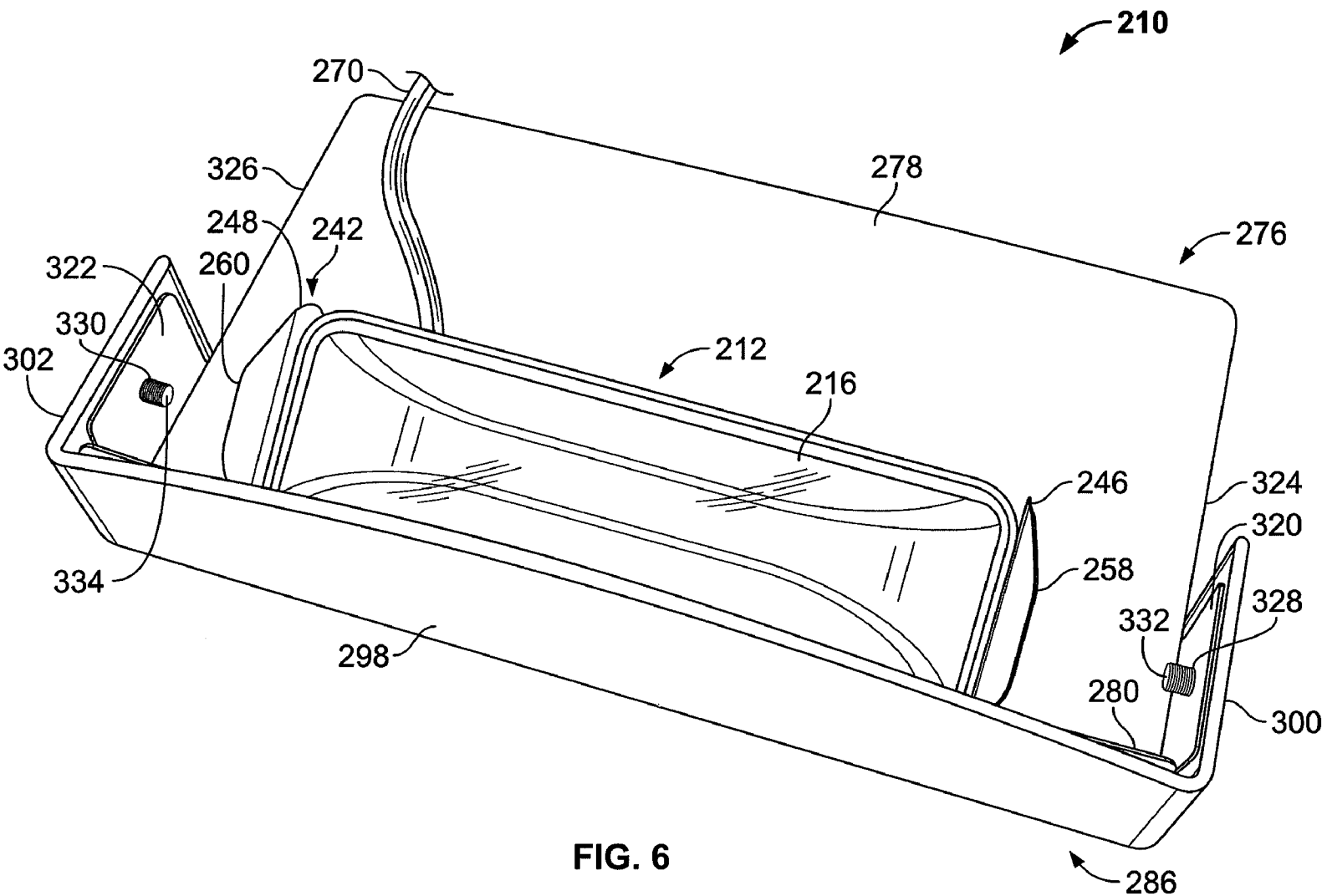
FIG. 6 is a perspective view, looking from below, of a lighting fixture according to a second exemplary embodiment of the present invention.

FIG. 6 is a view beneath a fully-assembled lighting fixture 210 according to a second exemplary embodiment of the invention. The lighting fixture 210 may be described as a modification of the lighting fixture 10 described with reference to FIGS. 1-4. Elements illustrated in FIG. 6 which are counterparts to any of the elements 10 through 118 described above with reference to FIGS. 1-4 have been designated by corresponding reference numerals increased by two hundred. The lighting fixture 210 shown in FIG. 6 may be constructed and used in manners consistent with the foregoing description of the lighting fixture 10 of FIGS. 1-4, unless it is stated otherwise.

In the lighting fixture 210 shown in FIG. 6, the mounting plate 276 is provided with extensions 320, 322 (hereinafter, ears 320, 322) that extend out of the plane of the mounting plate body 278 and may be perpendicular thereto. The ears 320, 322 are positioned on opposite edges 324, 326 of the mounting plate body 278 and may be aligned with the lamp holder 242, most of which is concealed by the modular lamp assembly 212 in the view presented in FIG. 6. Threaded openings 328, 330 are provided in the respective ears 320, 322 to receive respective screws 332, 334. The stop members 300, 302 of the skirt 286 are also provided with openings (not shown) to receive respective screws 332, 334. The openings of the stop members 300, 302 are positioned so as to align with the respective threaded openings 328, 330 of the ears 320, 322 when the face plate 298 is adjacent to the mounting plate flange 280. It is not necessary that any screw holes be provided through the face plate 298 or mounting plate flange 280 (of which only a small portion is visible in FIG. 6).

Figure 7:
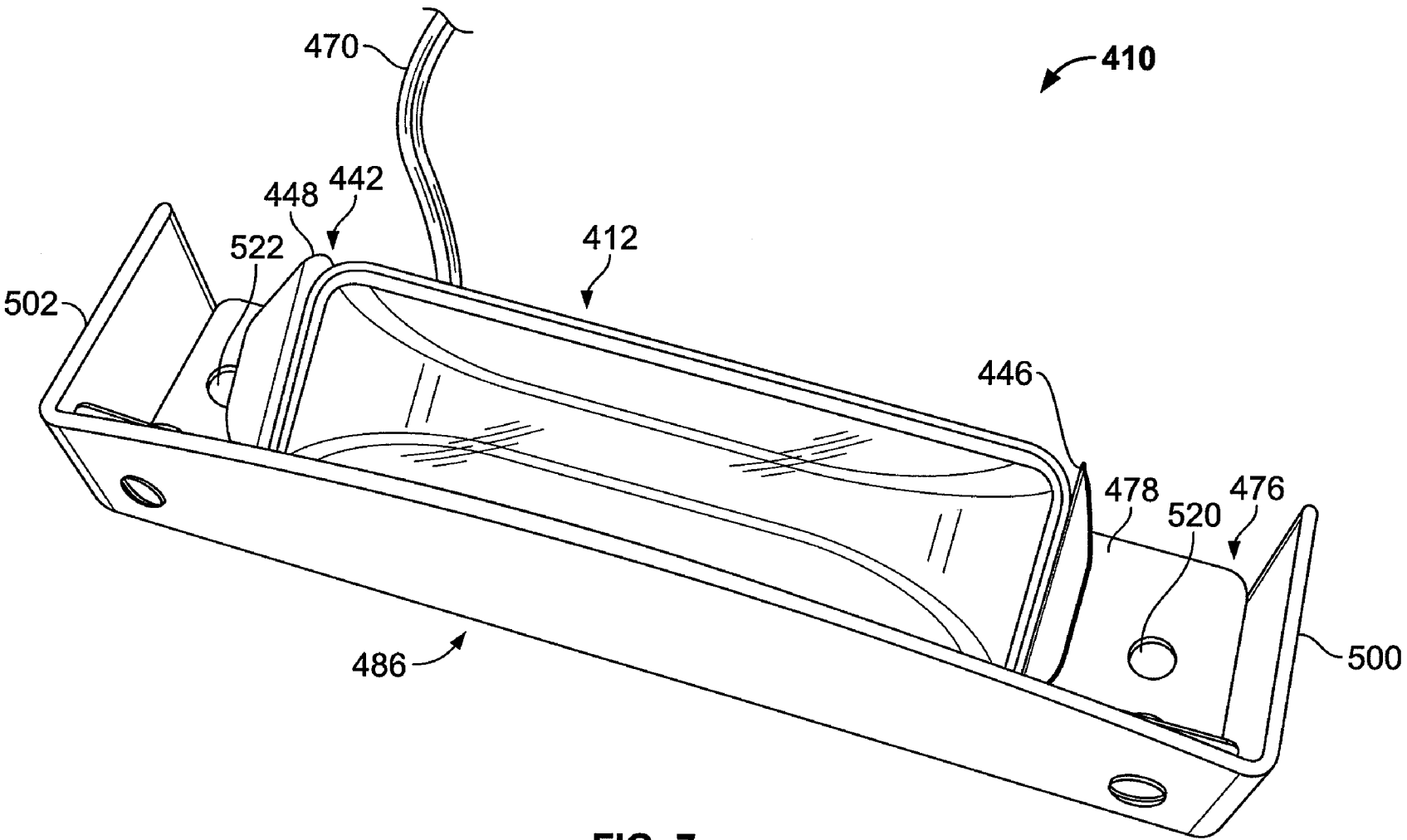
FIG. 7 is a perspective view, looking from below, of a lighting fixture according to a third exemplary embodiment of the present invention.

FIG. 7 is a view of a fully-assembled lighting fixture 410 according to a third exemplary embodiment of the invention. The lighting fixture 410 may be described as a modification of the lighting fixture 10 described with reference to FIGS. 1-4. Elements illustrated in FIG. 7 which are counterparts to any of the elements 10 through 118 described above with reference to FIGS. 1-4 have been designated by corresponding reference numerals increased by four hundred. The lighting fixture 410 shown in FIG. 7 may be constructed and used in manners consistent with the foregoing description of the lighting fixture 10 of FIGS. 1-4, unless it is stated otherwise.

In the lighting fixture 410 shown in FIG. 7, the mounting plate body 478 is provided with openings 520, 522 for receiving mounting screws (not shown). The openings 520, 522 may be located proximate to the respective retaining members 446, 448 of the lamp holder 442, which is partially concealed by the modular lamp assembly 412 in the view presented in FIG. 7. The length of the mounting plate body 478 is about the same as the length of the stop members 500, 502 of the skirt 486.

Figure 8:
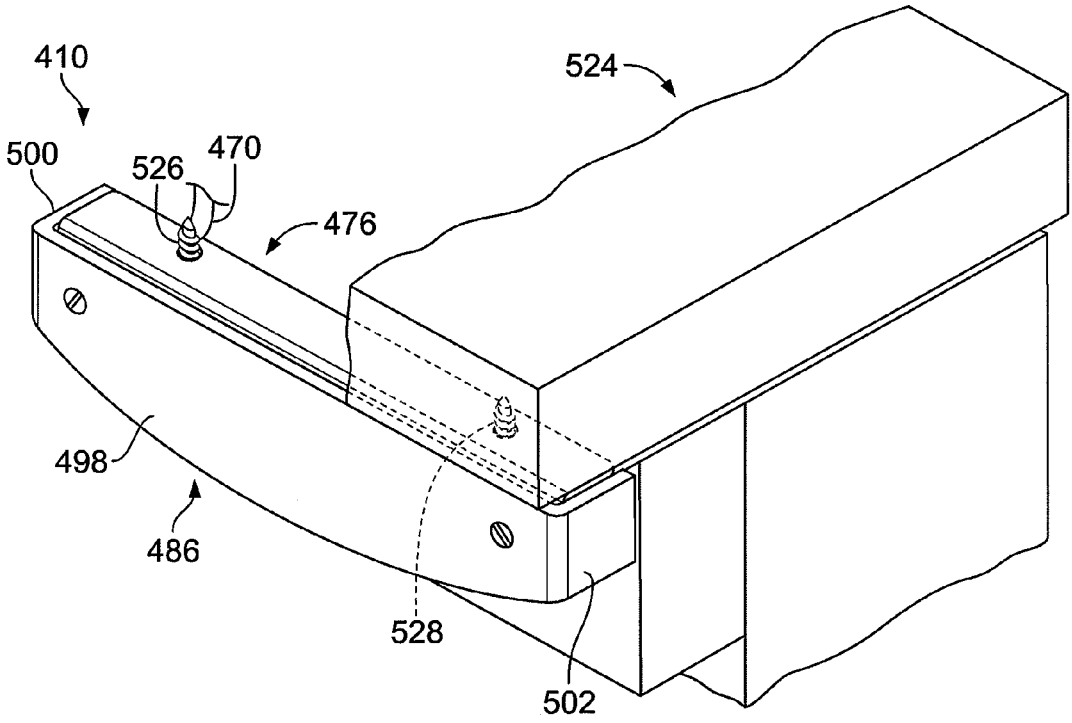
FIG. 8 is a perspective view, looking from above, of the lighting fixture of FIG. 7 in an installation according to the present invention.

As illustrated in FIG. 8, the configuration of the lighting fixture 410 of FIG. 7 is such that it may be conveniently installed beneath an overhanging portion of a wooden deck 524. The lighting fixture 410 may be conveniently secured to the deck 524 using mounting screws 526, 528 or other securing means, such as adhesives. Other possible installations, such as installing the lighting fixture 410 beneath the tread of a stair, will be apparent to those persons knowledgeable in the construction trades.

Figure 9:
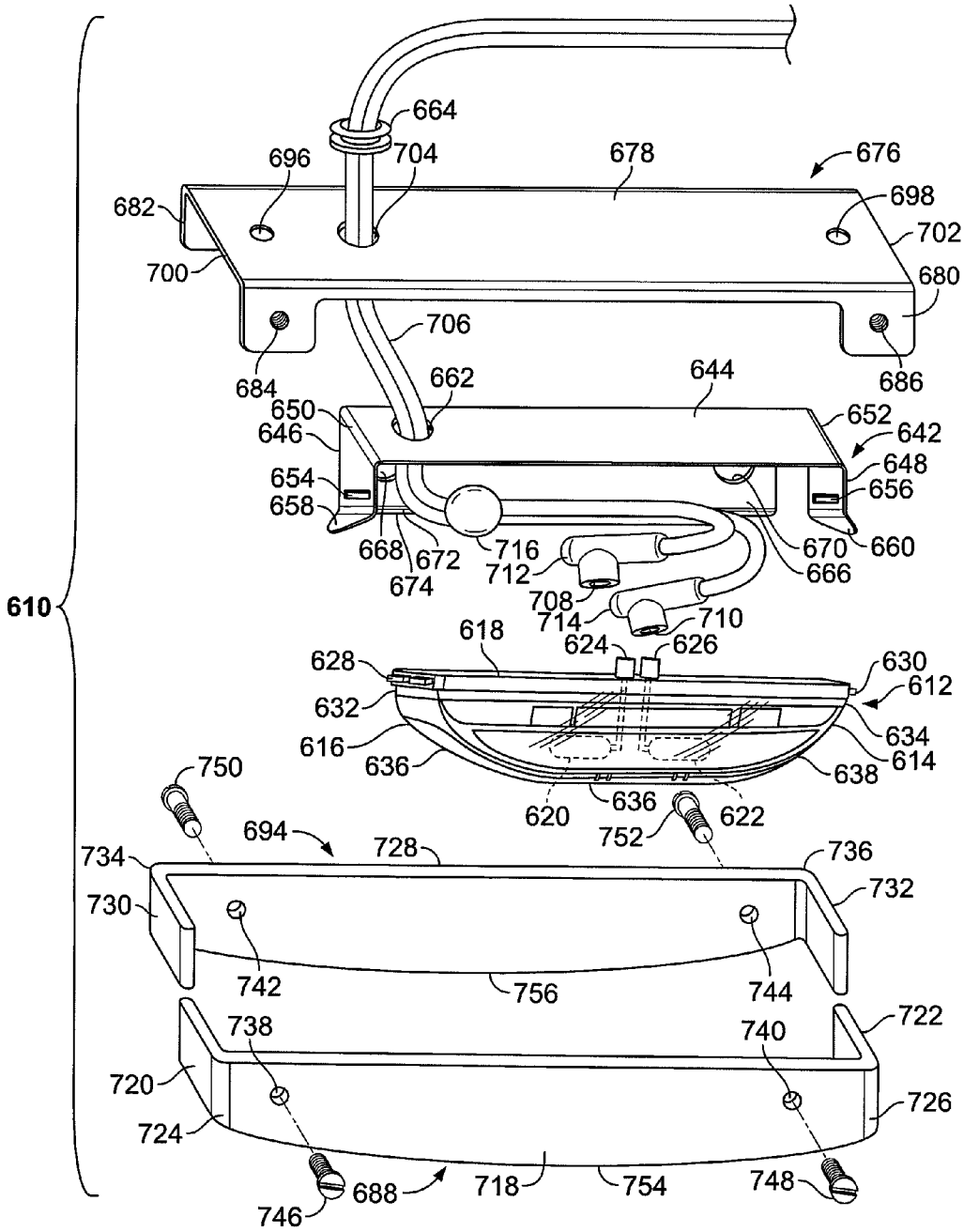
FIG. 9 is an exploded perspective view, looking from above, of a lighting fixture according to a fourth exemplary embodiment of the present invention.

FIG. 9 is an exploded view of a lighting fixture 610 according to a fourth exemplary embodiment of the present invention. The view is generally taken from the front of the lighting fixture 610. Orientations and views discussed with respect to this embodiment, such as "front", "rear", "right", "left", "top", "bottom", "inward" and "outward", are relative to the view presented in FIG. 9, except where variations from this scheme are explicitly described.

The lighting fixture 610 comprises a sealed modular lamp assembly 612 of the same general type as the sealed modular lamp assembly 12 of FIG. 1. The sealed modular lamp assembly 612 has a housing 614 with a light-transmitting cover 616 and an electrically-insulating back plate 618. The back plate 618 is sealed to the cover 616 so as to prevent liquids or water vapor from entering the housing 614. The modular lamp assembly 612 further contains one or more self-contained light sources, such as the light bulbs 620, 622 of the embodiment of the modular lamp assembly 612 shown in FIG. 9. The light sources are electrically connected to electrical contacts, such as the electrically-conductive posts 624, 626 exposed at the back plate 618. The modular light assembly 612 is also provided with rigid tabs 628, 630 protruding from opposite ends 632, 634 of the housing 614. In the embodiment of FIG. 9, the tabs 628, 630 are provided on the cover 616.

The cover 616 may be transparent or translucent, clear or colored, and may contain optical elements to distribute light from the light sources in a desired pattern. For example, in the embodiment of FIG. 9, the cover 616 is shaped such that light from the light bulbs 620, 622 may be directed through the front side 636 and sloped sides 638, 640 of the cover 616, thus providing even illumination. The cover 616 may be made of any of a number of light-transmitting materials, such as the impact-resistant polycarbonate plastic known as LEXAN®.

An example of a modular lamp assembly 612 that may be beneficially employed in lighting fixtures according to the embodiment illustrated in FIG. 9 is Model No. 19200 manufactured by Truck-Lite Company (Falconer, N.Y.).

Returning to both FIGS. 9 and 10, the lighting fixture 610 further comprises a lamp holder 642 having a planar middle portion 644 and flexible retaining members 646, 648 at opposite ends 650, 652 of the middle portion 644. The retaining members 646, 648 extend out of the plane of the middle portion 644 and may be perpendicular thereto. The retaining members 646, 648 are provided with slots 654, 656 that are sized and shaped to releasably engage the tabs 628, 630, respectively, of the modular lamp assembly 612. End portions 658, 660 of the retaining members 646, 648 may be angled outwardly from the middle portion 644 of the lamp holder 642 so as to act as levers for flexing the retaining members 646, 648, respectively, during removal and replacement of the modular lamp assembly 612, as discussed elsewhere herein. Angled end portions 658, 660 are referred to hereinafter as wings 658, 660. The middle portion 644 of the lamp holder 642 is further provided with an opening 662 that is sized and shaped to receive an elastic grommet 664.

Figure 10:
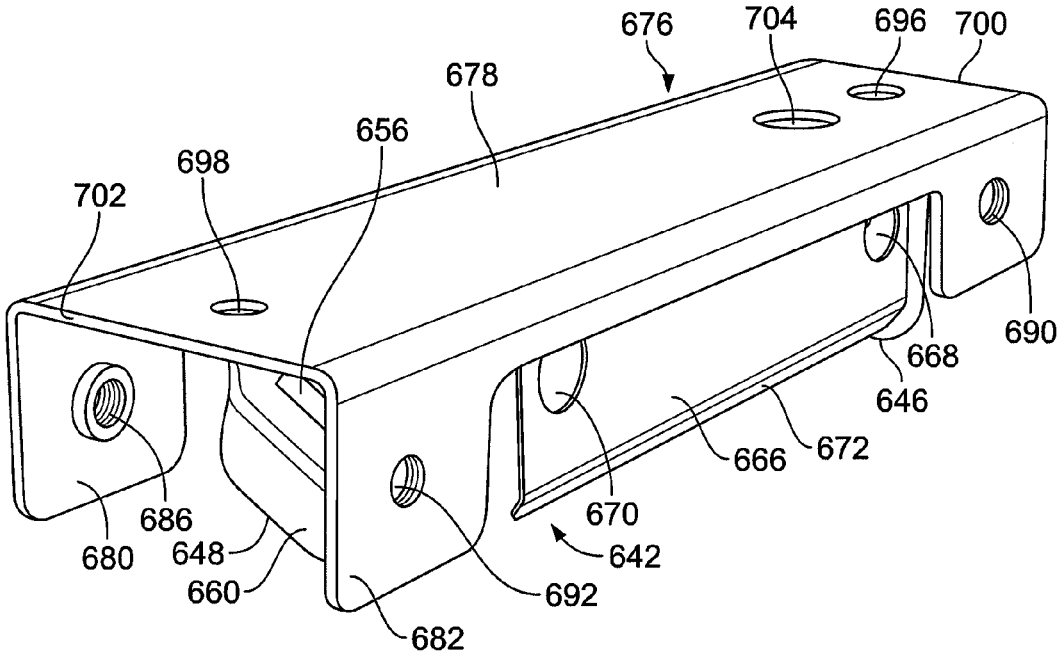
FIG. 10 is a first perspective view, looking from above, of components of the lighting fixture of FIG. 9 in a partially-assembled state.

Continuing to refer to FIGS. 9 and 10, the lamp holder 642 may also be provided with a flange 666 at the back of the lamp holder 642 that extends out of the plane of the middle portion 644 of the lamp holder 642 and may be perpendicular thereto. If present, the lamp holder flange 666 extends in the same general direction as the retaining members 646, 648. The lamp holder flange 666 may have one or more openings, such as openings 668, 670, although such openings are not necessary in the embodiment of FIGS. 9 and 10. The lamp holder flange 666 may also be provided with a lip 672 along the free edge 674 of the lamp holder flange 666. In the embodiment of FIGS. 9 and 10, the lip 672 is continuous along the free edge 674 of the lamp holder flange 666 and is bent slightly toward the front of the lamp holder 642. As will be evident to a person of ordinary mechanical skill, it is not necessary that the lip 672 be a single continuous piece. It may be noted that the lamp holder flange 666 is not a necessary part of the lamp holder 642, but, when provided as in the embodiment of FIGS. 9 and 10, may advantageously serve to provide support to the modular lamp assembly 612, as will be discussed elsewhere herein.

Continuing to refer to FIGS. 9 and 10, the middle portion 644 of the lamp holder 642, the retaining members 646, 648 and the lamp holder flange 666 are sized and shaped so as to secure the modular lamp assembly 612 in position when the tabs 628, 630 are engaged with their respective slots 654, 656. The slots 654, 656 may be oriented such that the modular lamp assembly 612 projects its light at a desired angle (e.g., slots 54, 56 may be oriented at 30 degrees from the plane of the mounting plate body 678, so that light is directed away from the mounting plate body 678 at an angle of 60 degrees). The orientation of the slots 654, 656 can be varied for different fixtures.

Continuing to refer to FIGS. 9 and 10, the lighting fixture 610 further comprises a mounting plate 676 having a substantially planar mounting plate body 678 and respective first and second mounting plate flanges 680, 682 that extend out of the plane of the mounting plate body 678 and may be perpendicular thereto. In the embodiment of FIGS. 9 and 10, the first mounting plate flange 680 is provided with at least two threaded openings 684, 686, which are used in fastening a first skirt 688 to the first mounting plate flange 680, as is discussed more fully elsewhere herein. The second mounting plate flange 682 is also provided with two threaded openings 690, 692 for use in fastening a second skirt 694 to the second mounting plate flange 682. The first and second mounting plate flanges 680, 682 of the embodiment of FIGS. 9 and 10 are U-shaped, and the mounting plate flange nearest the modular lamp assembly 612 (i.e., first mounting plate flange 680) is configured so that it will not block insertion and removal of the modular lamp assembly 612.

The mounting plate body 678 is provided with two openings 696, 698 sized and shaped to receive mounting screws (not shown). The openings 696, 698 are located near the respective ends 700, 702 of the mounting plate body 678. The mounting plate body 678 is further provided with an opening 704 that is sized and shaped to receive the elastic grommet 664. It would be advantageous for the opening 704 in the mounting plate body 678 to be of the same size as the opening 662 in the middle portion 644 of the lamp holder 642 such that, when the respective openings 662, 704 are closely aligned with each other, the grommet 664 may be accommodated within both openings 662, 704 at the same time.

Continuing to refer to FIGS. 9 and 10, the mounting plate body 678 and the middle portion 644 of the lamp holder 642 are constructed such that they may be attached one to the other with the opening 662 in the middle portion 644 of the lamp holder 642 aligned with the opening 704 in the mounting plate body 678. The middle portion 644 of the lamp holder 642 may be permanently attached to the mounting plate body 678 by spot welding. Other methods of attaching these components will be understood by one having ordinary skill in the mechanical arts. Suitable methods may include the use of screws, adhesives or tongue-and-groove arrangements.

The lighting fixture 610 is further provided with electrical components 706, 708, 710 to conduct electrical current to the modular lamp assembly 612. The embodiment of FIGS. 9 and 10 includes the electrical cord 706, which has wires therein (not shown) which are electrically connected to sockets 708, 710. The sockets 708, 710 are sized and shaped to fit over the respective posts 624, 626 at the back plate 618 of the modular lamp assembly 612, so as to form mechanical and electrical connections with the posts 624, 626. The sockets 708, 710 are insulated and protected by socket holders 712, 714, which are located at one end of the electrical cord 706. In the embodiment of FIGS. 9 and 10, the electrical cord 706 is shown as being routed through openings 662, 704 and grommet 664 with the socket holders 712, 714 in front of the lamp holder flange 666. The electrical cord 706 is provided with a stop 716 to prevent the electrical cord 706 and socket holders 712, 714 from being withdrawn through the openings 662, 704, and is positioned to ensure that enough of the electrical cord 706 remains in front of the lamp holder flange 666 such that the socket holders 712, 714 may be conveniently manipulated so as to attach the sockets 708, 710 to the posts 624, 626 or remove them therefrom while the modular lamp assembly 612 is detached from the lamp holder 642. The grommet 664 is sized and shaped such that the electrical cord 706 may pass therethrough and such that it may be fitted into the openings 662, 704 when they are aligned. Various suitable means of connecting the lighting fixture 610 to a source of electrical power (not shown), such as using electrical plugs, batteries, or power taps, will be apparent to persons having ordinary skill in electrical installations.

Continuing to refer to FIGS. 9 and 10, the lighting fixture 610 is also provided with the aforementioned first and second skirts 688, 694. First skirt 688 has a face plate 718 and stop members 720, 722 at its respective ends 724, 726. Second skirt 694 has a face plate 728 and stop members 730, 732 at its respective ends 734, 736. The stop members 720, 722, 730, 732 extend out of the planes of the respective face plates 718, 728 and may be perpendicular thereto. Each skirt 688, 694 is provided with a respective pair of openings 738, 740, 742, 744, each which may be aligned with a respective threaded openings 684, 686, 690, 692 on a mounting plate flange 680, 682 such that each of the skirts 688, 694 may be attached to its respective mounting plate flange 680, 682 using screws, such as screws 746, 748, 750, 752, inserted through an opening 738, 740, 742, 744 in a faceplate 718, 728 and into a threaded opening 684, 686, 690, 692, respectively. Other methods of fastening a skirt to a mounting plate flange, such as by the use of adhesives, will be understood by one having ordinary skill in the mechanical arts. In other embodiments of the lighting fixture 610, a gasket (not shown) may be installed between the face plate 718, 728 of either skirt 668, 694 and its respective mounting plate flange 680, 682 to provide additional protection against the infiltration of water.

Each skirt 688, 694 is sized and shaped to conceal the respective mounting plate flange 680, 682 when the lighting fixture 610 is viewed from the front or back. The front skirt (i.e., the first skirt 688) is sized so as to also conceal a substantial portion of the cover 616 of the modular lamp assembly 612 when the lighting fixture 610 is assembled and viewed from the front. The stop members 720, 722, 730, 732 of each skirt 688, 694 should be sized and shaped such that the stop members 720, 722 of the first skirt 688 contact the stop members 730, 732 of the second skirt 694 when both skirts 688, 694 are attached to their respective mounting plate flanges 680, 682. In some embodiments of the skirts 688, 694, the face plates 718, 728 and stop members 720, 722, 730, 732 are opaque. In other embodiments, they may be made of a material that transmits light, or be provided with optical or dichroic lenses. The face plates 718, 728 or stop members 720, 722, 730, 732 may be painted, embossed, debossed or textured, or other surface treatments may be applied. In the embodiment of the lighting fixture of 610 of FIGS. 9 and 10, the skirts 688, 694 are crescent-shaped along their respective lower edges 754, 756, approximating the curvature of the cover 616 of the modular lamp assembly 612 in the embodiment of FIG. 9. In this embodiment, an effect of the crescent-shape is that light passing through the sloped sides 636, 638 of the cover 616 of the modular lamp assembly 612 is not blocked by the face plates 718, 728 or stop members 720, 722, 732, 734.

Figure 11:
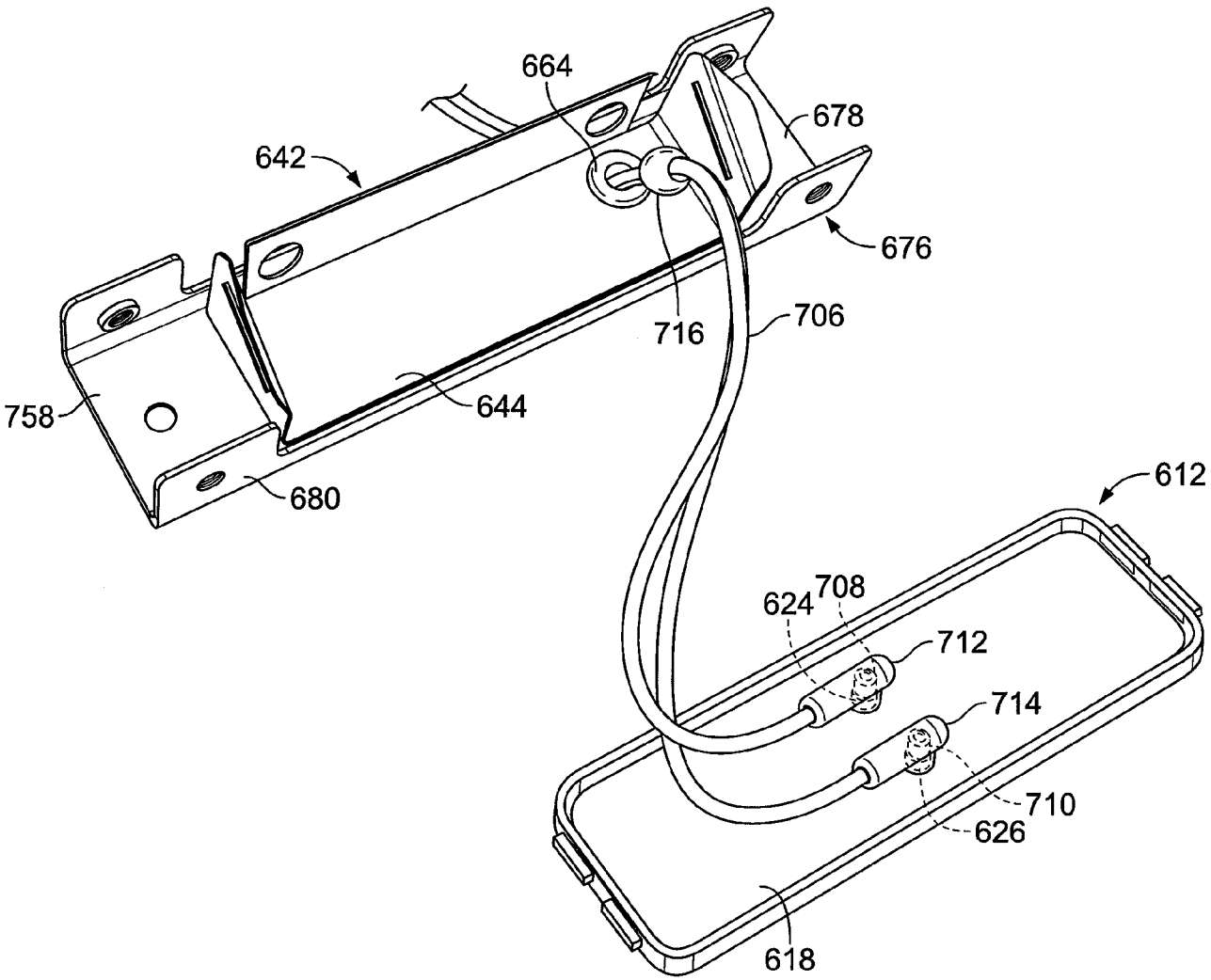
FIG. 11 is a second perspective view, looking from below, of components of the lighting fixture of FIG. 9 in a further partially-assembled state.
Figure 12:
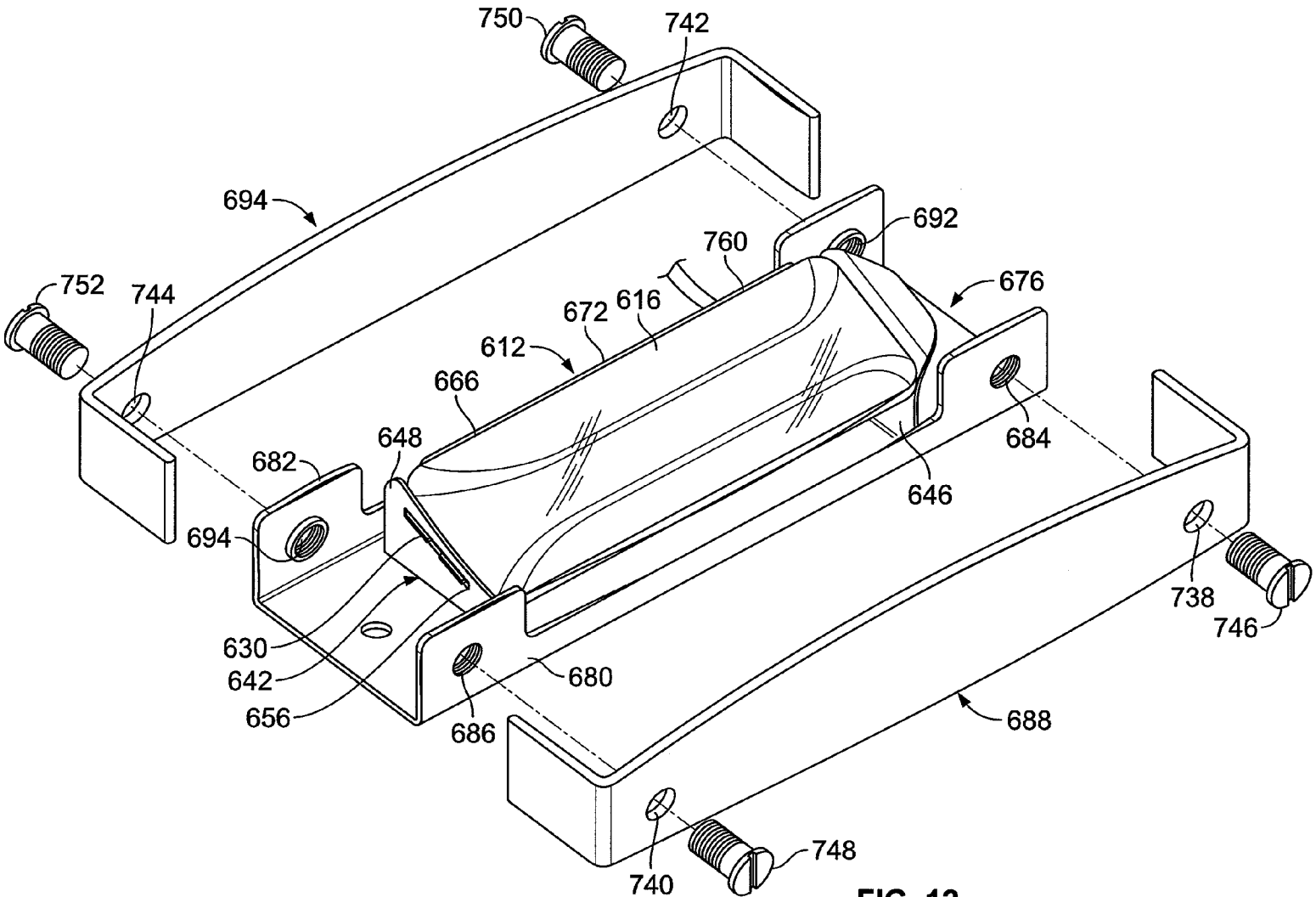
FIG. 12 is a third perspective view, looking from below, of the lighting fixture of FIG. 9 in a yet further partially-assembled state.

FIGS. 11 and 12 illustrate components of the lighting fixture 610 of FIG. 9 in various stages of assembly. These figures, when read in succession, suggest a convenient sequence for assembling the lighting fixture 610. However, as will be obvious from previous discussions related to FIGS. 1-4, FIGS. 11 and 12 do not limit the sequence in which the parts may be assembled.

In FIG. 11, which is a view beneath and in front of the mounting plate 676, the middle portion 644 of the lamp holder 642 has been affixed to the underside 758 of the mounting plate 676. The lamp holder 642 is located proximate to the first mounting plate flange 680 such that the socket holders 712, 714 of the electrical cord 706 are readily accessible from the front of the lighting fixture 610. The grommet 664 is secured within the opening (not shown) in the middle portion of the lamp holder 642 and the corresponding opening (not shown) in the mounting plate body 678, both openings being aligned with each other. The electrical cord 706 passes through the grommet 664. The stop 716 is positioned relative to the socket holders 712, 714 such as to allow enough electrical cord 706 between the stop 716 and the socket holders 712, 714 such that the socket holders 712, 714 and the back plate 618 of the modular lamp assembly 612 may be conveniently accessed when the modular lamp assembly 612 is free of lamp holder 642. The posts 624, 626 of the modular lamp assembly 612 are securely held within the sockets 708, 710 in socket holders 712, 714.

In FIG. 12, which is also a view beneath the mounting plate 676, the modular lamp assembly 612 has been secured in the lamp holder 642, most of which is concealed by the modular lamp assembly 612 in this view. A lamp holder tab 630 can be seen within its respective slot 656 in retaining member 648. A similar arrangement is present at the other retaining member 646, but is concealed in the view of FIG. 12. The rear edge 760 of the housing 614 of the modular lamp assembly 612 is supported by the lip 672 of the lamp holder flange 666.

Continuing with FIG. 12, the first and second skirts 688, 694 are positioned with their respective openings 738, 740, 742, 744 aligned with the respective threaded openings 684, 686, 692, 694 of the first and second mounting plate flanges 680, 682. The screws 746, 748, 750, 752 for fastening the skirts 688, 694 to the mounting plate flanges 680, 682 are also shown in an alignment appropriate for attaching the skirts 688, 694 to the mounting plate flanges 680, 682.

Figure 13:
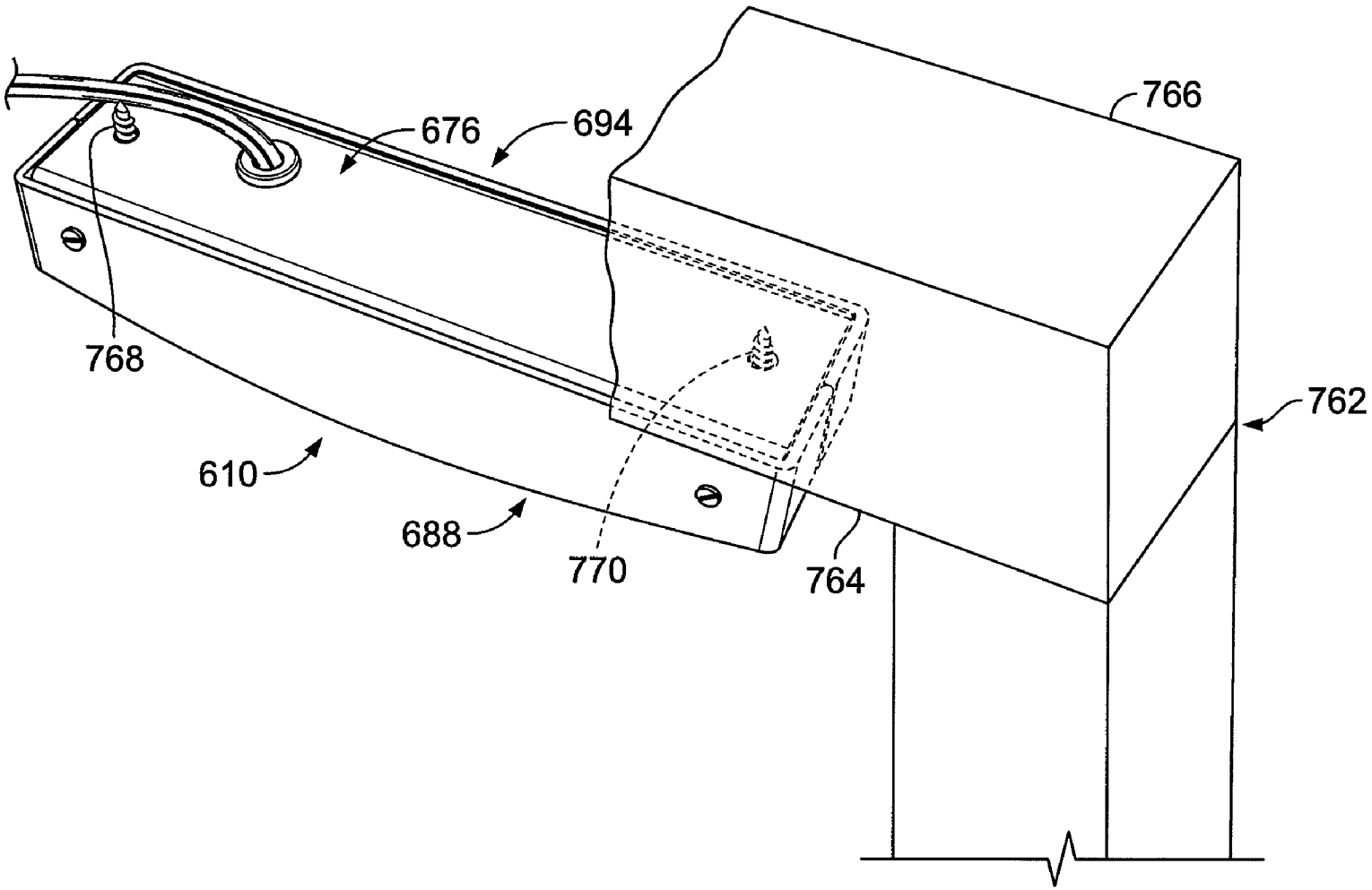
FIG. 13 is a perspective view, looking from above, of the lighting fixture of FIG. 9 in an installation according to the present invention.

FIG. 13 is an environmental view of the fully-assembled lighting fixture 610 of FIG. 9 in one of a number of possible installations. In the particular installation illustrated in FIG. 13, the mounting plate 676 of the lighting fixture 610 is mounted to a railing 762 such that both skirts 688, 694 are exposed. As illustrated in FIG. 13, the lighting fixture 610 may be attached to the underside 764 of the railing cross-piece 766 by mounting screws 768, 770. Other useful installations of lighting fixture 610, such as the deck or stair installations discussed with reference to FIGS. 7 and 8, will be apparent to those persons knowledgeable in the construction trades or the art of landscape design. Other methods of affixing the lighting fixture 610 within an installation, such as the use of adhesives, will also be apparent.

The various elements of the lighting fixture 610 illustrated in FIGS. 9-13, and discussed with reference thereto, should be sized and shaped such that, when the lighting fixture 610 is fully assembled and installed, the modular lamp assembly 612, the retaining members 646, 648 of the lamp holder 642, and the socket holders 712, 714 of the electrical cord 706 are readily accessible from beneath the lighting fixture 610. For an installation of the lighting fixture 610 such as those discussed with reference to FIG. 13, such access should be sufficient to allow removal and replacement of the modular lamp assembly 612 without removing either skirt 688, 694 from its respective mounting plate flange 680, 682. However, in other embodiments of the lighting fixture 610, removal of one or both skirts may be desirable or necessary to allow the modular lamp assembly 612 to be removed or replaced. With all such arrangements in mind, the removal and replacement of the modular lamp assembly 612 may be performed in a manner similar to that discussed with respect to the embodiment of the lighting fixture 10 illustrated in FIGS. 1-4.

Figure 14:
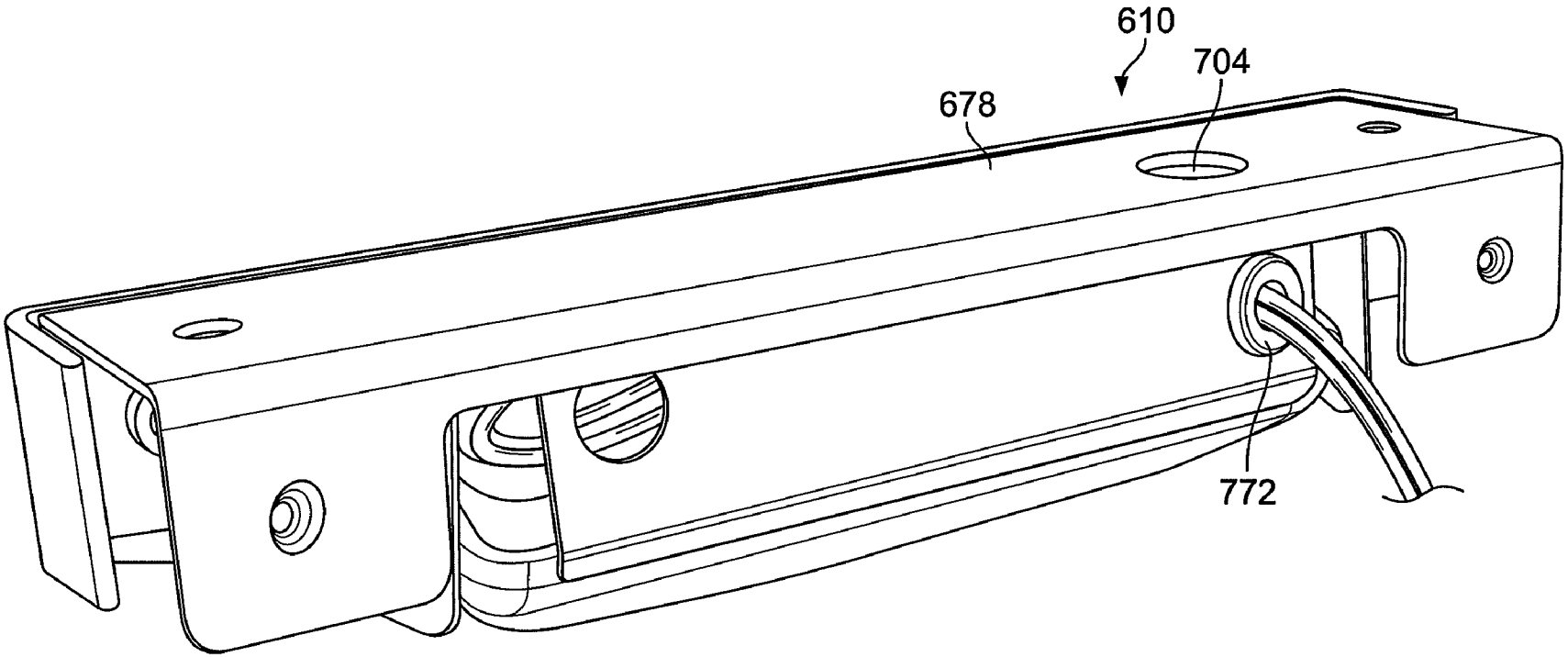
FIG. 14 is a perspective view, looking from above, of the lighting fixture of FIG. 9 in an alternative configuration to that shown in FIG. 13.

FIG. 14 is a view from behind the lighting fixture 610 of FIG. 9, in a configuration that does not employ the second skirt 694. Referring to FIG. 14, an elastic grommet 772 is fitted to an opening (not shown) in the lamp holder flange 666 and the electrical cord 706 passes through the grommet 772. No grommet is present in the opening 704 in the mounting plate body 678. In the configuration shown in FIG. 14, the lighting fixture 610 may usefully installed as discussed for the embodiment of the lighting fixture 410 illustrated in FIGS. 7 and 8. In other embodiments, the lighting fixture 410 illustrated in FIG. 14 may be provided with a skirt having longer stop members, such as stop members that extend the entire distance between the mounting plate flanges (similar to the skirt 498 of FIG. 8).

Figure 15:
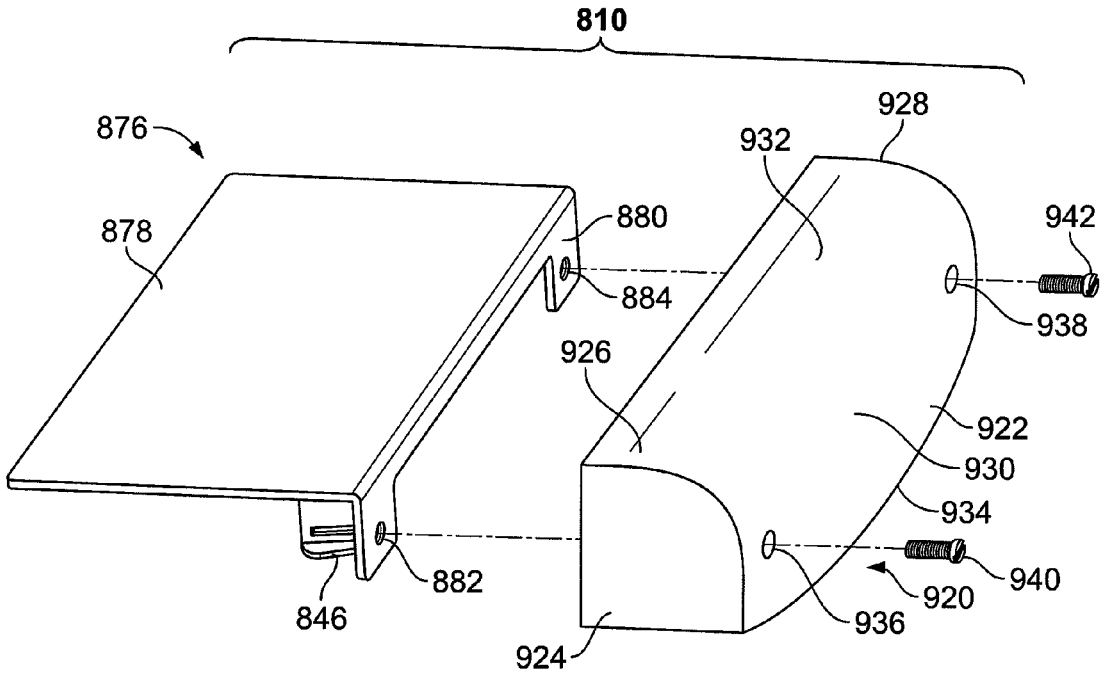
FIG. 15 is an exploded perspective view, looking from above, of components of a lighting fixture according to a fifth exemplary embodiment of the invention.
Figure 16:
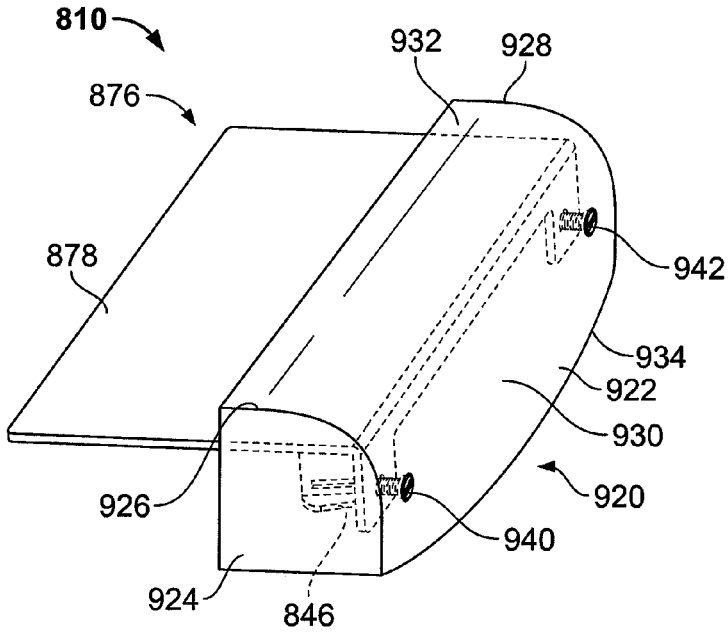
FIG. 16 is a perspective view, looking from above, of the components shown in FIG. 15 in an assembled state.

FIG. 15 is an exploded perspective view of components of a lighting fixture 810 according to a fifth embodiment of the present invention. FIG. 16 is a perspective view of the assembled components of the lighting fixture 810 shown in FIG. 15. The lighting fixture 810 may be described as a modification of the lighting fixture 10 described with reference to FIGS. 1-4. Elements illustrated in FIGS. 15 and 16 which are counterparts to any of the elements 10 through 118 described above with reference to FIGS. 1-4 have been designated by corresponding reference numerals increased by eight hundred. The lighting fixture 810 shown in FIGS. 15 and 16 may be constructed and used in manners consistent with the foregoing description of the lighting fixture 10 of FIGS. 1-4, unless it is stated otherwise.

FIGS. 15 and 16 show a mounting plate 876 and a retaining member 846 that is intended to represent a lamp holder 842 similar to the lamp holder of lighting fixture 10. Counterparts to the other components of lighting fixture 10, except its skirt 98, should be considered as being present in lighting fixture 810, but have been omitted from FIGS. 15 and 16 for clarity. Lighting fixture 810 further includes a skirt 920 having a face plate 922, a stop member 924 at one end 926 of the face plate 922 and a counterpart stop member (not shown) at the other end 928 of the face plate 922. The descriptions made herein regarding stop member 924 are also applicable to its unseen counterpart at end 928 of the face plate 922. The face plate 922 has a front portion 930 that is sized and shaped to be attached to the flange 880 of the mounting plate 876 and an upper portion 932 that extends over the mounting plate body 878. The front portion 930 and the upper portion 932 are continuous one with the other and with the stop member 924. It is not necessary, however, that the stop member 924 be continuous with both the front portion 930 and the upper portion 932 of the face plate 922. Further, in the embodiment of the lighting fixture 810 shown in FIGS. 15 and 16, the face plate 922 is smoothly curved from the front portion 930 to the upper portion 932. In other embodiments, the transition between the front portion 930 and upper portion 932 of the face plate 922 may be angular. It is also not necessary that the transition from the face plate 922 to the stop member 924 be angular as shown in FIGS. 15 and 16. In other embodiments, the transitions from the face plate 922 to the stop member 924 may be smoothly curved, and the stop member 924 itself may be curved, for example, in a shape resembling a quarter-portion of the top half of a sphere. It may also be noted that the lower edge 934 of the front portion 930 of the face plate 922 is crescent-shaped, similar to the shape of the lower edge 116 of the face plate 98 shown in FIG. 1. The front portion 930 of the face plate 922 is also provided with openings 936, 938, which are positioned such that the face plate 922 may be fastened to the flange 880 of the mounting plate 876 using screws, such as screws 940, 942, inserted through the openings 936, 938 and into the threaded openings 882, 884 of the flange 880. Other skirts conforming to the description of skirt 920 and of its other embodiments may be molded or cast from metals, such as iron, brass or copper, or from plastics.

As best seen in FIG. 16, the skirt 920 is sized and shaped such that the front portion 930 of the face plate 922 conceals the flange 880 of the mounting plate 876 (shown in phantom in FIG. 16) when the face plate 922 is fastened to the flange 880. The skirt 920 is further sized and shaped such that the upper portion 932 and stop member 924 extend from the front portion 930 past the lamp holder (represented in FIG. 16 by a phantom view of its retaining member 846) when the face plate 922 is fastened to the flange 880. It may be noted that it is not necessary that the front portion 930 of the face plate 922 be fastened to the flange 880 in order to secure the skirt 920 to the mounting plate 876. In other embodiments, the upper portion 932 of the face plate 922 may be fastened to the mounting plate body 878, or the stop member 924 may be fastened to one of a pair of ears (not shown) extending from the mounting plate body 878 in a fashion similar to the ears 320, 322 discussed with reference to lighting fixture 210 of FIG. 6. The arrangements of the various openings, threaded openings and screws necessary to effect such embodiments, as well as the use of other fastening means, will be obvious to one having ordinary skill in the mechanical arts in view of the disclosures made with reference to FIGS. 1-4 and 6, as well as other disclosures made elsewhere herein.

Figure 17:
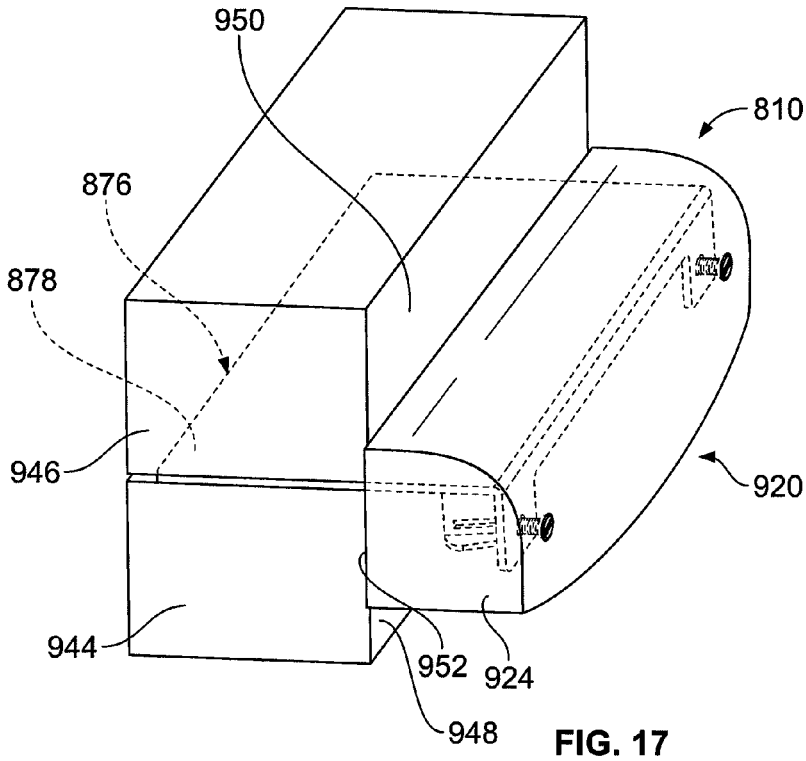
FIG. 17 is a perspective view, looking from above, of the assembled components of FIG. 16 in an installation according to the present invention.

Turning to FIG. 17, the lamp fixture 810 is shown environmentally in one of a number of possible installations. In the particular installation illustrated in FIG. 17, the mounting plate body 878 is positioned between a lower masonry block 944 and an upper masonry block 946, such as may be used in masonry retaining walls, in such a way that the upper masonry block 946 rests on the mounting plate body 878. In the installation shown in FIG. 17, the respective faces 948, 950 of the lower and upper masonry blocks 944, 946 are aligned and lie in the same vertical plane. The stop member 924 is in contact with both faces 948, 950. The end 952 of the stop member 924 is flat to match the faces 948, 950 of the masonry blocks 944, 946. It is not necessary that the stop member 924 contacts the faces 948, 950 of the masonry blocks 944, 946, but it may, instead, be spaced away from faces 948, 950.

Possible installations of the lighting fixture 810 are not limited to installation in masonry retaining walls. For example, the lighting fixture 810 may also be installed between bricks in a brick structural or decorative wall, or in walls made of wooden boards or railroad ties. Other useful installations of the lighting fixture 810 will be apparent to those persons knowledgeable in the construction trades or the arts of hardscape or landscape design.

Figure 18:
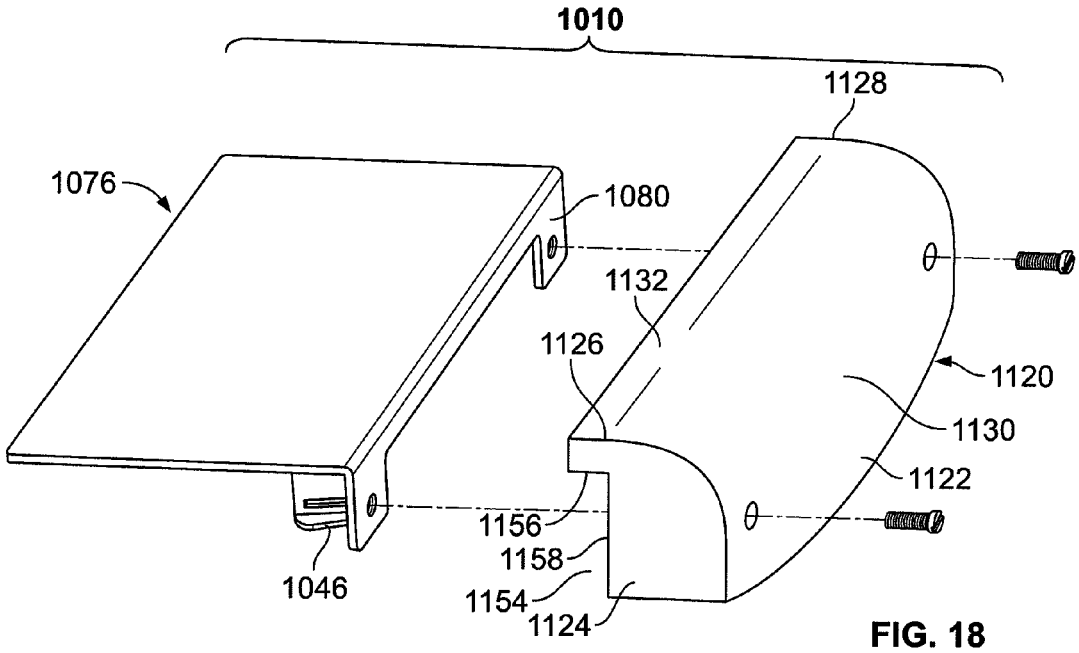
FIG. 18 is an exploded perspective view, looking from above, of components of a lighting fixture according to a sixth exemplary embodiment of the invention.
Figure 19:
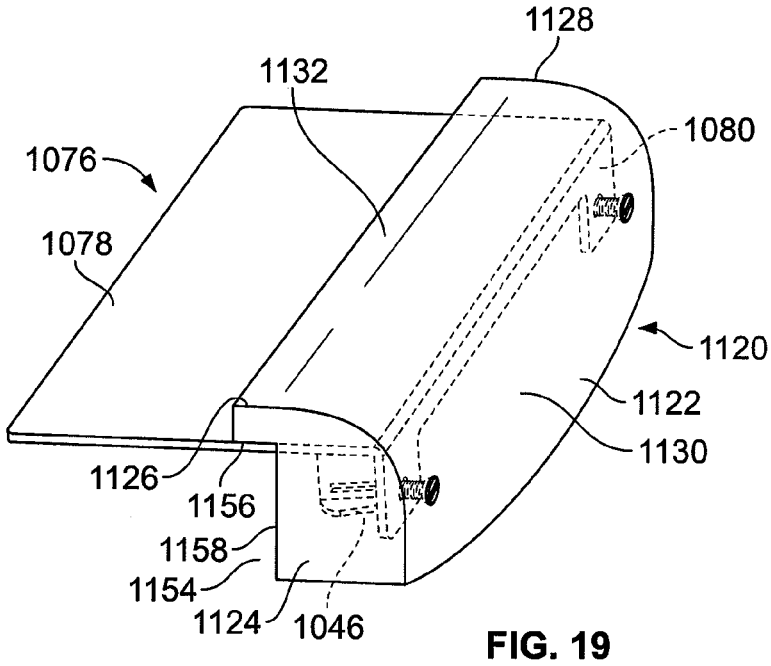
FIG. 19 is a perspective view, looking from above, of the components of FIG. 18 in an assembled state.

FIG. 18 is an exploded perspective view of components of a lighting fixture 1010 according to a sixth embodiment of the present invention. FIG. 19 is a perspective view of the assembled components of the lighting fixture 1010 shown in FIG. 18. The lighting fixture 1010 may be described as a modification of the lighting fixture 10 described with reference to FIGS. 1-4, or of lighting fixture 810 described with reference to FIGS. 15 and 16. Elements illustrated in FIGS. 18 and 19 which are counterparts to any of the elements 10 through 118 described above with reference to FIGS. 1-4 have been designated by corresponding reference numerals increased by one thousand. The skirt of FIGS. 18 and 19 is a counterpart of the skirt 920 of FIGS. 15 and 16, and the elements of the skirt 922 which are counterparts to any of the elements described above with reference to the skirt 920 of FIGS. 15 and 16 have been designated by corresponding reference numerals increased by two hundred. The lighting fixture 1010 shown in FIGS. 18 and 19 may be constructed and used in manners consistent with the foregoing descriptions of the lighting fixture 10 of FIGS. 1-4, or of the lighting fixture 810 of FIGS. 15 and 16 unless it is stated otherwise.

FIGS. 18 and 19 show a mounting plate 1076 and a retaining member 1046 that is intended to represent a lamp holder similar to the lamp holder 42 of lighting fixture 10. Counterparts to the other components of lighting fixture 10, except its skirt 98, should be considered as being present in lighting fixture 1010, but have been omitted from FIGS. 18 and 19 for clarity. The skirt 1120 of lighting fixture 1110 includes a face plate 1122, a stop member 1124 at one end 1126 of the face plate 1122 and a counterpart stop member (not shown) at the other end 1128 of the face plate 1122. The descriptions made herein regarding stop member 1124 are also applicable to its unseen counterpart at end 1128 of the face plate 1122. The description of the skirt 920 of FIGS. 15 and 16 also applies to the skirt 1120 except as otherwise noted herein. In a particular exception, the stop member 1124 is provided with an angular cut-out 1154, defined by edges 1156, 1158 which are adjacent to each other. The arrangement of the edges creates a step-like shape in the stop member.

As best seen in FIG. 19, the skirt 1120 is sized and shaped such that the front portion 1130 of the face plate 1122 conceals the flange 1080 (shown in phantom in FIG. 19) when the face plate 1122 is fastened to the mounting plate 1076. The skirt 1120 is further sized and shaped such that the upper portion 1132 and stop member 1124 extend from the front portion 1130 past the lamp holder (represented in FIG. 16 by a phantom view of its retaining member 1046) when the face plate 1122 is fastened to the mounting plate 1076. More specifically, the edge 1158 of the cut-out 1154 is located beyond the lamp holder such that the lamp holder is at least mostly concealed by the stop member 1124.

Figure 20:
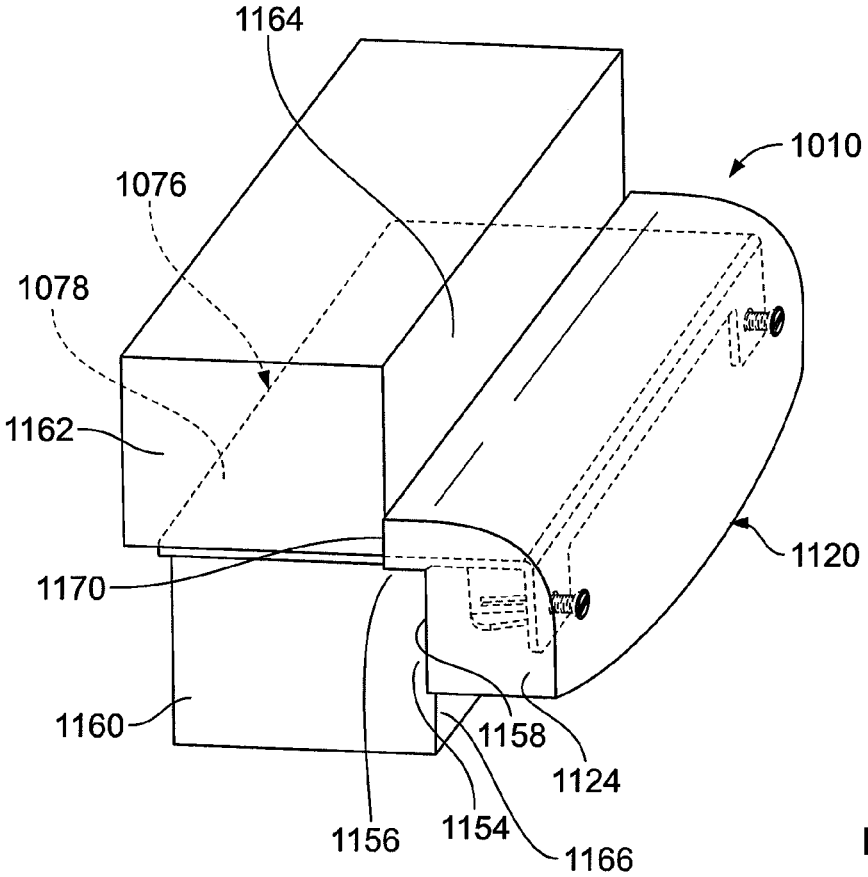
FIG. 20 is a perspective view, looking from above, of the assembled components of FIG. 19 in an installation according to the present invention.

Turning to FIG. 20, the lamp fixture 1010 is shown environmentally in one of a number of possible installations. In the particular installation illustrated in FIG. 20, the mounting plate body 1078 is positioned between a lower masonry block 1160 and an upper masonry block 1162, such as may be used in masonry retaining walls, in such a way that the upper masonry block 1162 rests on the mounting plate body 1160. In the installation shown in FIG. 20, the face 1164 of the upper masonry block 1162 is set back from the face 1166 of the lower masonry block 1160, exposing an upper surface 1168 of the lower masonry block 1160 in a step-like formation. The edge 1156 of the cut-out 1154 in the stop member 1124 is in contact with the exposed upper surface 1168 of the lower masonry block 1160 and the edge 1158 of the cut-out 1154 is in contact with the face 1166 of the lower masonry block. The back edge 1170 of the stop member 1124 is in contact with the face 1164 of the upper masonry block 1162. In other embodiments, where the transition between the upper surface 1168 of the lower masonry block 1160 and the face 1164 of the upper masonry block 1168 is other than step-like, the stop member may be provided with cut-outs complementary to such a transition. Further, the stop member 1124 may be scored to mark locations where the stop member 1124 may be cut or broken to create cut-outs, similar to cut-out 1154, of standard sizes.

Possible installations of the lighting fixture 1010 are not limited to installation in masonry retaining walls having a step-like arrangement. For example, the lighting fixture 1010 may also be installed between stepped bricks in a brick structural or decorative wall, or in stepped walls made of wooden boards or railroad ties. Other useful installations of the lighting fixture 1010 will be apparent to those persons knowledgeable in the construction trades or the arts of hardscape or landscape design.

Figure 21:
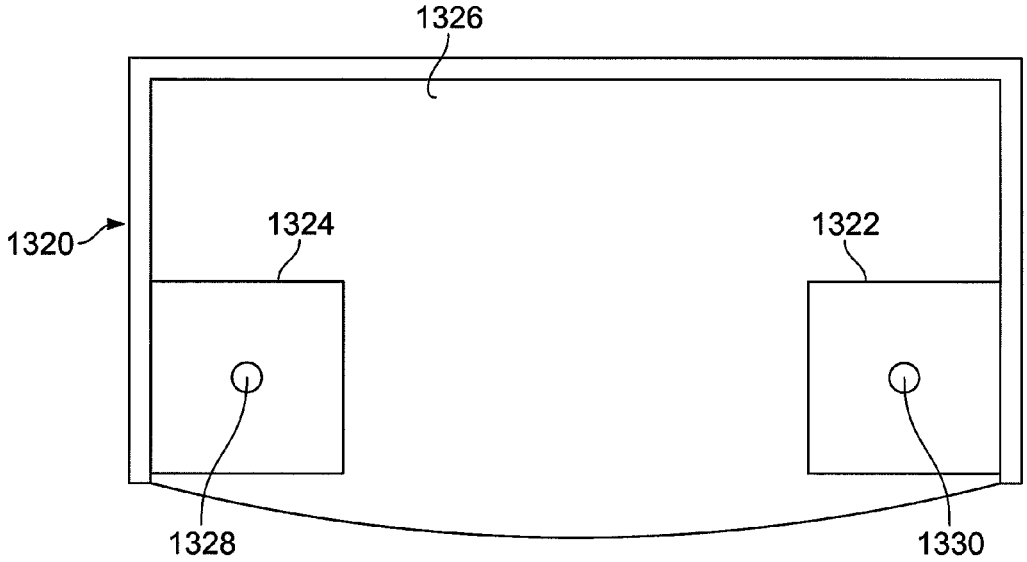
FIG. 21 is a view, looking from behind, of a component of a lighting fixture according to a seventh exemplary embodiment of the invention.
Figure 22:
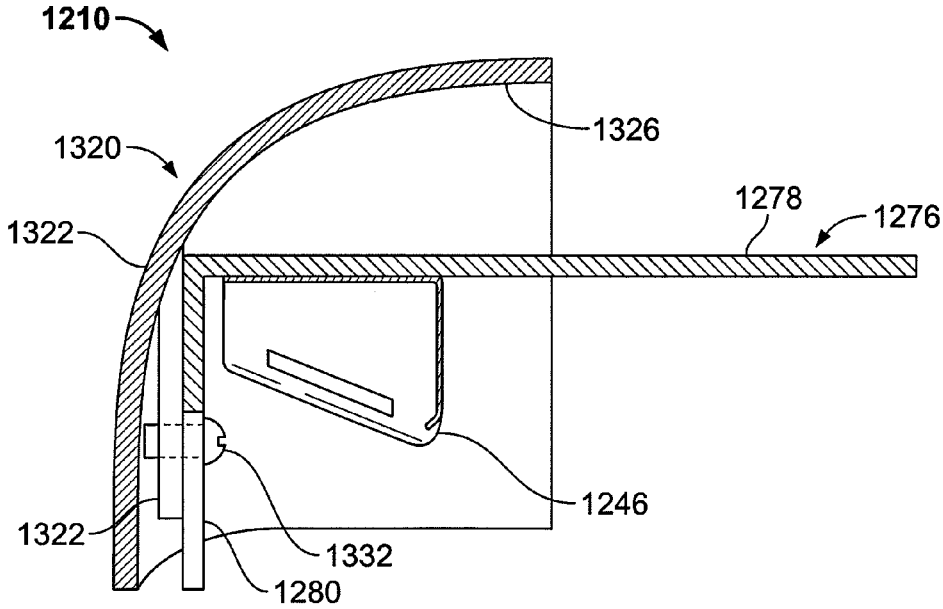
FIG. 22 is a side cross-sectional view of the lighting fixture according to the seventh exemplary embodiment of the invention.

FIGS. 21 and 22 illustrate portions of a lighting fixture 1210 according to a seventh embodiment of the invention. The lighting fixture 1210 may be described as a modification of the lighting fixture 10 described with reference to FIGS. 1-4, or lighting fixture 810 described with reference to FIGS. 15 and 16. Elements illustrated in FIGS. 21 and 22 which are counterparts to any of the elements 10 through 118 described above with reference to FIGS. 1-4 have been designated by corresponding reference numerals increased by twelve hundred. The skirt 1320 of FIGS. 21 and 22 is a counterpart of the skirt 920 of FIGS. 15 and 16, and the elements of the skirt 1320 which are counterparts to any of the elements described above with reference to the skirt 920 of FIGS. 15 and 16 have been designated by corresponding reference numerals increased by four hundred. The lighting fixture 1210 shown in FIGS. 21 and 22 may be constructed and used in manners consistent with the foregoing descriptions of the lighting fixture 10 of FIGS. 1-4, or of the lighting fixture 810 of FIGS. 15 and 16 unless it is stated otherwise. Further, it should be noted that the skirt 1320 of FIGS. 21 and 22 can be readily modified by those having ordinary skill in the mechanical arts to include the additional features described in relation to lighting fixture 1010 of FIGS. 18-20 based on the disclosures made with respect to those figures.

FIG. 21 shows a rear view of the skirt 1320 which has interior tabs 1322, 1324 molded, cast or otherwise formed as part of or attached to the inside wall 1326 of the skirt 1320. FIG. 22 shows a side cross-sectional view of the skirt 1320 attached to the flange 1280 of the mounting plate 1278. Referring to FIGS. 21 and 22 together, the interior tabs 1322, 1324 are provided with threaded openings 1328, 1330 to receive screws, such as screw 1332. The flange 1280 is provided with unthreaded openings (not shown) positioned similarly to threaded openings 82, 84 of flange of FIG. 1, and sized and shaped to receive respective screws, such as screw 1332.

Referring again to FIGS. 21 and 22, the internal tabs 1322, 1324 and their respective threaded openings 1328, 1330 are arranged so that a screw may be inserted through the opening in the face plate 1280 and a respective threaded opening 1328, 1340 in an internal tab 1322, 1324. This arrangement allows the face plate 1322 to be fastened to the flange 1280 from beneath the mounting plate 1276, making it unnecessary to provide openings through the face plate 1322. Other arrangements of internal tabs may be used to fasten the skirt 1320 to the mounting plate body 1278 or to ears (not shown), such as the ears 320, 322 of lighting fixture 410 discussed in relation to FIG. 6, as will apparent to one having ordinary skill in the mechanical arts in view of disclosures made elsewhere herein. Possible installations of the lighting fixture 1210 will be understood by those having knowledge of the possible installations of lighting fixtures 810,1010, as discussed in relation to FIGS. 17 and 20.

Figure 23:
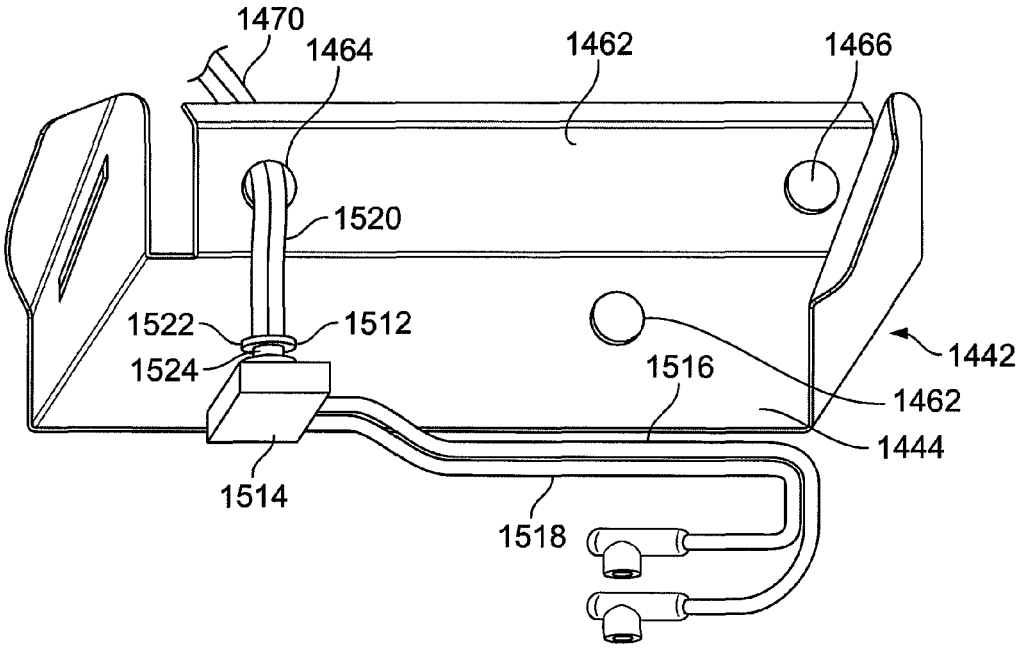
FIG. 23 is a view, looking from above, of a strain relief according to the present invention in association with a component common to the lighting fixtures of FIGS. 1, 6, 7, 9, 15, 18 and 21.
Figure 24:
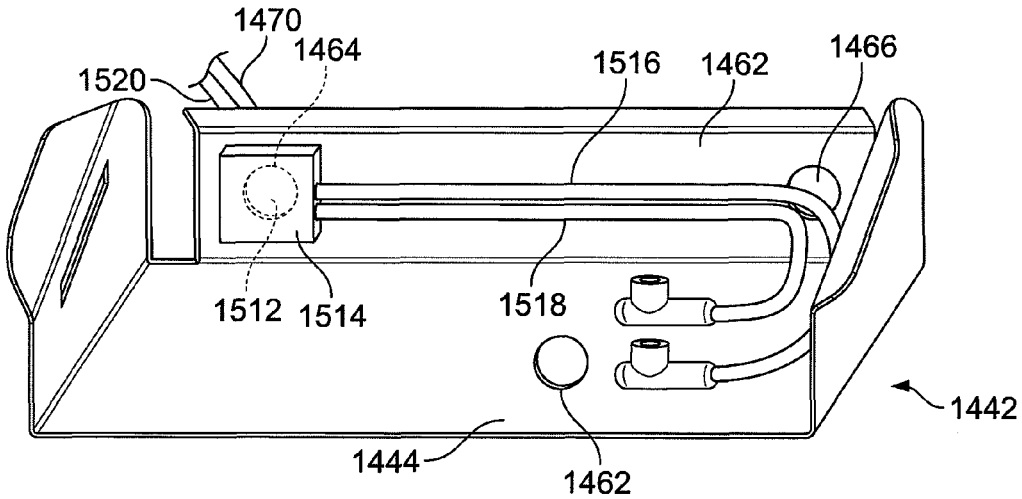
FIG. 24 is a view, looking from above, of the strain relief of FIG. 23 installed in the component of FIG. 23.

FIGS. 23 and 24 illustrate a unitary plug and stopper combination (hereinafter "strain relief 1510"). A strain relief having the disclosed features of strain relief 1510 may be used in any of the exemplary embodiments of the lighting fixtures 10, 210, 410, 610, 810, 1010 and 1210 discussed herein. Strain relief 1510 is shown and described with reference to the environment of a lamp holder 1442, similar to lamp holder 42 of FIGS. 1 and 2, and various electrical components. Elements discussed with reference to FIGS. 23 and 24 which are counterparts to any of the elements 42 through 96 described above with reference to FIG. 1 or 2 have been designated by corresponding reference numerals increased by fourteen hundred.

Strain relief 1510 comprises an elastic plug portion 1512 that is arranged to be fitted securely into one of openings 1464, 1466 of lamp holder 1442 and is integral with a stopper portion 1514. FIG. 23 shows the strain relief 1510 with the plug portion 1512 outside of the opening 1464. The strain relief 1510 may be molded as part of an electrical cord 1470 having two electrical conductors (not shown) such that the electrical conductors extend individually from the stopper portion 1514 of the strain relief 1510 in separate cords 1516, 1518 at an angle of 90 degrees from the direction at which a portion 1520 of the electrical cord 1470 extends out of the plug portion 1512 of the strain relief 1510. In other embodiments, the electrical conductors may extend from the stopper portion 1514 in a single cord ( not shown) which is divided into two cords similar to cords 1516, 1518 at a distance from the stopper block 1514. It may be noted that the plug portion

1512 has a free end 1522 and a mid-portion 1524 that is narrow compared to the free end 1522 such as to fit in the opening 1464. This arrangement is similar to that of the outside portion of an elastic grommet, such as that of grommet 68 of FIG. 1, that is intended for secure insertion into an opening.

FIG. 24 shows the strain relief 1510 with the plug portion 1512 fitted into the opening 1464. Such an arrangement provides benefits over the arrangement of grommet 68, stopper 96 and electrical cord 70 of FIGS. 1 and 2. Referring to FIGS. 1 and 2, the arrangement of the grommet 68 and stopper 96 allows the electrical cord 70 to be drawn toward the mounting plate flange through the grommet 68, increasing the amount of electrical cord 70 within the lamp holder 42. The stopper 96 then has to be pushed back toward the grommet 68 to reduce the amount of the electrical cord 70 within the lamp holder 42 to an amount that can be conveniently handled during replacement of the modular lamp assembly 12. Referring to FIG. 24, the strain relief 1510 is fixed in place in the opening 1464, keeping a fixed amount of the cords 1516, 1518 within the lamp holder 1442. Further, the direction at which the cords 1516, 1518 extend from the strain relief 1510 tends to direct the cords 1516, 1518 along the lamp holder flange 1462, making it easier to replace the cords 1516, 1518 within the lamp holder 1442 in a preferred J-formation, as shown in FIG. 24. In alternative embodiments, the plug portion may be inserted into an opening 1462 in the middle portion 1444 of the lamp holder 1442, in which embodiments, the cords 1516, 1518 would be directed along the middle portion 1444.

It should be understood that the embodiments described herein are merely exemplary and that a person skilled in the art may make many variations and modifications thereto without departing from the spirit and scope of the present invention. For example, although the particular embodiments of the modular lamp assembly are provided with tabs, differently-shaped projecting members, such as posts, may be provided at the ends of the housing. The slots of the lamp holder retaining members would then be shaped to receive such projecting members. The lip of the lamp holder flange could then be shaped so as to removably secure an edge of the housing, thus holding the modular lamp assembly in position. In another embodiment, the retaining members could be provided with a shape that is complementary to the ends of the modular lamp assembly or configured so as to provide a friction fit with the modular lamp assembly. In the place of the post and socket arrangement described herein, the electrical contacts of the modular lamp assembly could be provided in the form of a socket, or provided on an electrical cord having a plug or socket. In other embodiments, the face plate of the skirt could be provided with a plurality of flat surfaces in a bowed arrangement. The front edge of the mounting plate could be shaped to match the bowed arrangement and provided with a plurality of flanges for securing and stabilizing the face plate. All such variations and modifications, including those discussed above, are intended to be included within the scope of the invention, which is described, in part, in the claims presented below.

What is claimed is:

1. A lighting fixture for use with a lamp assembly having a sealed housing with first and second ends opposite each other and electrical contacts exposed outside of said housing, said lighting fixture comprising:

a mounting plate having a substantially planar mounting plate body and an extension of said mounting plate body extending out of the plane of said mounting plate body; and a lamp holder having a substantially planar middle portion affixed to a surface of said mounting plate body, said lamp holder further having first and second retaining members extending out of the plane of said middle portion, each of said first and second retaining members including a respective securing means to secure a respective one of said first and second ends of said lamp assembly such that said lamp assembly is held at a fixed angle relative to said mounting plate body when both of said first and second ends of said housing are secured by said respective securing means.

2. The lighting fixture of claim 1, wherein each of said first and second retaining members has a respective free end, said free end of said first retaining member being movable away from said free end of said second retaining member.

3. The lighting fixture of claim 2, wherein said free end of said first retaining member is sized and shaped so as to form a levering means for moving said free end of said first retaining member away from said free end of said second retaining member.

4. The lighting fixture of claim 2, wherein at least one of said first and second ends of said housing has a protruding member and said securing means of at least one of said first and second retaining members has an opening therethrough for receiving said protruding member.

5. The lighting fixture of claim 4, wherein said protruding member is a tab having a rectangular cross-section and said opening is a slot that mated to said tab.

6. The lighting fixture of claim 1, wherein said securing means are sized and shaped such that said lamp assembly is oriented so as to transmit light away from the plane of said mounting plate at an angle of less than 90 degrees relative to the plane of the mounting plate body when said first and second ends of said housing are secured in said securing means.

7. The lighting fixture of claim 1, further comprising an electrically-insulated cord having at least two electrical conductors therein, each of said electrical conductors terminating in an electrical contact that is mated to an electrical contact of said lamp assembly such as to form an electrical and mechanical connection with said electrical contact of said lamp assembly.

8. The lighting fixture of claim 7, further comprising a skirt attached to said extension, wherein said first and second retaining members are flexible and said mounting plate body, said extension, said middle portion of said lamp holder, said first and second retaining members, said securing means and said skirt are arranged such that said retaining means and said electrical contacts of said electrical conductors are accessible to a human hand such that said lamp assembly may be released from and secured between said securing means by processes that include flexure of said retaining members and said electrical contacts may be attached to and removed from said electrical contacts of said lamp assembly when said lamp assembly is not secured between said securing means.

9. The lighting fixture of claim 8, wherein each of said first and second retaining members has a respective free end that is sized and shaped so as form respective levering means for moving one of said each of said free ends away from the other of said free ends.

10. The lighting fixture of claim 8, wherein said lamp holder further comprises a flange having a free end positioned so as to guide placement of said lamp assembly through contact between said free end of said flange and said housing of said lamp assembly.

11. The lighting fixture of claim 1, wherein said lamp holder includes a flange extending out of the plane of said middle portion, said flange having a free end and being sized and shaped such that said free end contacts said housing when said first and second ends of said housing are secured in said securing means.

12. The lighting fixture of claim 11, wherein said flange of said lamp holder has an opening therethrough, said lighting fixture further comprising an electrically-insulated cord having at least two electrical conductors therein, each of said electrical conductors terminating in an electrical contact that is mated to an electrical contact of said lamp assembly such as to form an electrical and mechanical connection with said electrical contact of said lamp assembly, a grommet fitted in said opening of said flange and having a respective opening therethrough, said opening through said flange and said opening of said grommet being sized and shaped such that said cord may pass through said opening of said grommet, said cord being within said opening of said grommet, said cord having a stopper secured to and surrounding said cord, said stopper being substantially larger than said opening of said grommet and positioned between said flange and said electrical contacts of said electrical conductors.

13. The lighting fixture of claim 1, wherein said mounting plate body has a front edge and said extension of said mounting plate body extends from said front edge, said lighting fixture further comprising a skirt having a face plate with first and second ends opposite each other and first and second stop members extending in a common direction from respective ones of said ends of said face plate, said face plate being attachable to said extension such that each stop member is adjacent to said mounting plate body.

14. The lighting fixture of claim 13, wherein said housing has a light-transmitting cover has a curvature such that said cover is curved outward between said first and second ends of said housing and a light source within said housing, and said face plate has an edge that is curved such as to approximate said curvature of said cover.

15. The lighting fixture of claim 1, wherein said mounting plate body has two opposed side edges and said extension of said mounting plate body extends from one of said side edges, said lighting fixture further comprising another extension of said mounting plate body extending from the other side edge of said mounting plate such that one of said extensions extends on the same side of said plane of said mounting plate body as the other of said extensions, said lighting fixture further comprising a skirt having a face plate with first and second ends opposite each other and first and second stop members extending in a common direction from respective ones of said ends of said face plate, each of said stop members being attachable to a respective one of said extensions such that said face plate is adjacent to said mounting plate body.

16. The lighting fixture of claim 1, wherein said mounting plate body has another extension extending therefrom such that each of said extensions is opposite the other of said extensions and extends out of said plane of said mounting plate body on the same side of said plane as the other of said extensions.

17. The lighting fixture of claim 16, further comprising a first skirt affixed to one extension and a second skirt affixed to the other extension, each skirt having respective first and second stop members arranged such that each of said stop members is adjacent to said mounting plate body.

18. The lighting fixture of claim 17, wherein each of said stop members has a free end, each of said free ends being in contact with another of said free ends.

19. The lighting fixture of claim 17, further comprising an electrically-insulated cord having at least two electrical conductors therein, each of said electrical conductors terminating in an electrical contact that is mated to an electrical contact of said lamp assembly such as to form an electrical and mechanical connection with said electrical contact of said lamp assembly, wherein said first and second retaining members are flexible and said mounting plate body, said extension, said middle portion of said lamp holder, said first and second retaining members, said securing means and said first and second skirts are arranged such that said retaining members and said electrical contacts of said electrical conductors are accessible to a human hand such that said lamp assembly may be released from and secured between said securing means by processes that include flexure of said retaining members and said electrical contacts may be attached to and removed from said electrical contacts of said lamp assembly when said lamp assembly is not secured between said securing means.

20. The lighting fixture of claim 1, wherein said mounting plate body has another surface opposite said surface to which said lamp holder is affixed and an edge adjacent said another surface, said lighting fixture further comprising a skirt having a face plate with a first portion and a second portion that are connected so as to be transverse to each other and further having a stop member connected to said first and second portions and transverse thereto, said skirt being sized and shaped such that said second portion extends from said first portion over said another surface of said mounting plate and past said lamp holder when said first portion is extended along said edge and is transverse thereto, and said stop member extends from said first portion past said lamp holder when said first portion is extended along said edge and is transverse thereto, said skirt being attachable to said mounting plate such that said first portion extends along said edge and is transverse thereto.

21. The lighting fixture of claim 20, wherein said stop member has a first edge distal from said first portion of said face plate and a second edge distal from said second portion of said face plate, said first and second edges intersecting with each other such as to define a step-like cut-out into said stop member.

22. The lighting fixture of claim 20, wherein said skirt has an interior surface at least partially defined by said face plate and said stop member, said skirt further having tabs extending from said interior surface, said tabs being arranged such that attaching said tabs to said mounting plate causes said first portion of said face plate to become extended along said edge of said mounting plate body and transverse thereto

23. In combination, a lamp assembly having a sealed housing with first and second ends opposite each other and a cover with a light-transmitting portion, a light source within said housing, and electrical contacts exposed outside of said housing and electrically connected with said light sources; and a lighting fixture comprising a mounting plate having a substantially planar mounting plate body and an extension of said mounting plate body extending out of the plane of said mounting plate body, and a lamp holder having a substantially planar middle portion affixed to said mounting plate body, said lamp holder further having first and second retaining members extending out of the plane of said middle portion, each of said first and second retaining members including a respective securing means to secure a respective one of said first and second ends of said lamp assembly such that said lamp assembly is held in a fixed position when both of said first and second ends are secured by securing means.

* * * * *